US005937242A

United States Patent [19]

Yokoyama et al.

[11] Patent Number: 5,937,242

[45] Date of Patent: Aug. 10, 1999

[54] PROCESS CARTRIDGE AND ELECTROPHOTOGRAPHIC IMAGE FORMING APPARATUS

[75] Inventors: Katsunori Yokoyama, Susono; Kazushi Watanabe, Mishima; Atsushi Numagami, Hadano, all of Japan

[73] Assignee: Canon Kabushiki Kaisha, Tokyo, Japan

[21] Appl. No.: 09/017,734

[22] Filed: Feb. 3, 1998

[30] Foreign Application Priority Data

Feb. 3, 1997 [JP] Japan ..... 9-034389

[51] Int. Cl.[6] ..... G03G 21/18

[52] U.S. Cl. ..... 399/114; 399/111

[58] Field of Search ..... 399/107, 110, 399/113, 114, 116, 159, 111

[56] References Cited

U.S. PATENT DOCUMENTS

| | | | |
|---|---|---|---|
| 4,708,455 | 11/1987 | Kubota et al. | 399/111 |
| 4,829,334 | 5/1989 | Takamatsu et al. | 399/114 |
| 5,083,158 | 1/1992 | Kashima et al. | 399/114 |
| 5,113,220 | 5/1992 | Kwak | 399/114 |
| 5,266,999 | 11/1993 | Yashiro | 399/114 |
| 5,526,097 | 6/1996 | Ream | 399/111 X |
| 5,589,918 | 12/1996 | Oshida et al. | 399/114 |

*Primary Examiner*—Sandra Brase

*Attorney, Agent, or Firm*—Fitzpatrick, Cella, Harper & Scinto

[57] ABSTRACT

A process cartridge detachably mountable to a main body of an electrophotographic image forming apparatus includes a cartridge frame, an electrophotographic photosensitive member supported by the cartridge frame, a process device supported by the cartridge frame to act on the electrophotographic photosensitive member, and a shutter member for protecting a portion of the electrophotographic photosensitive member exposed from the cartridge frame. It further includes a first connection member to connect the cartridge frame and the shutter member. The first connection member is rotatable with respect to the cartridge frame and is detachably attached to the cartridge frame. Also provided is a second connection member to connect the cartridge frame and the shutter member. It is rotatable with respect to the cartridge frame and is attached to the cartridge frame while regulating an axial movement of the second connection member during rotation of the second connection member.

25 Claims, 17 Drawing Sheets

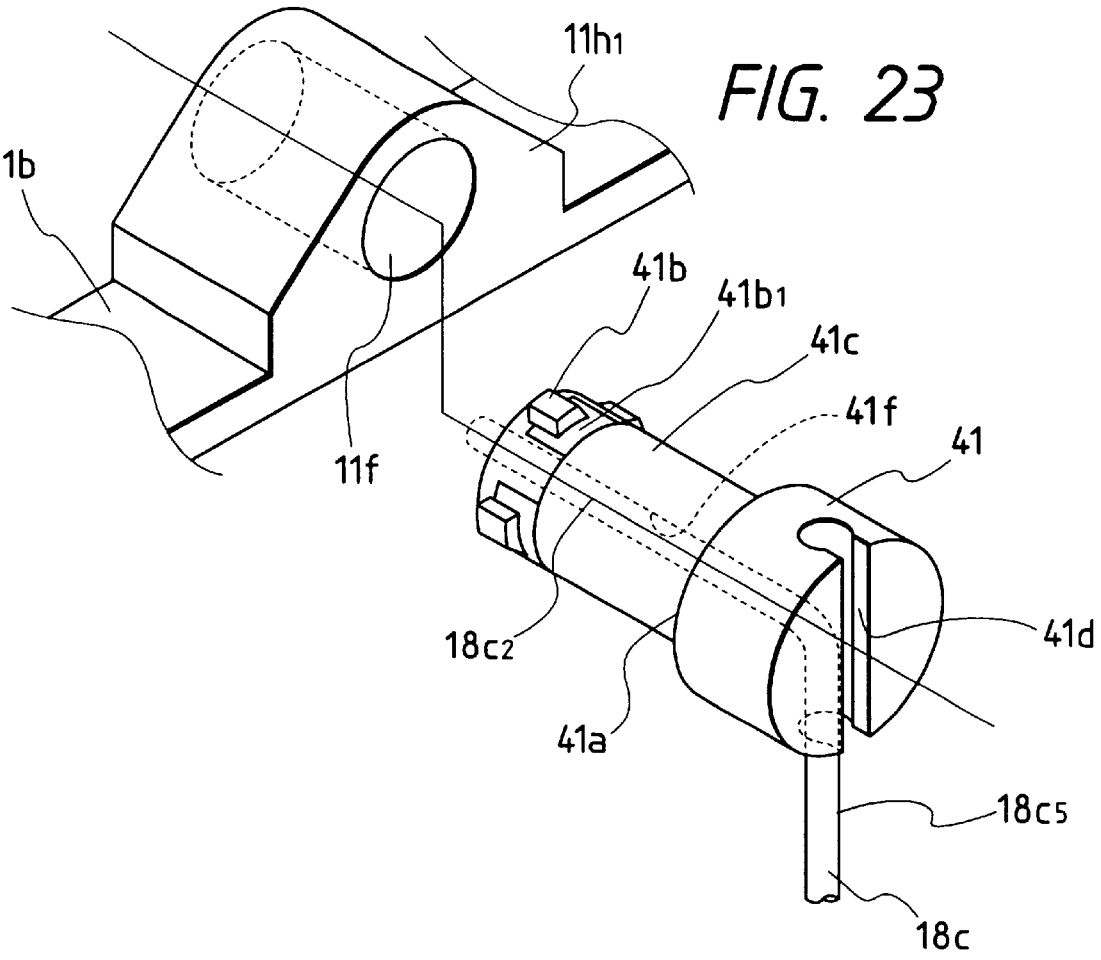
FIG. 23
FIG. 24
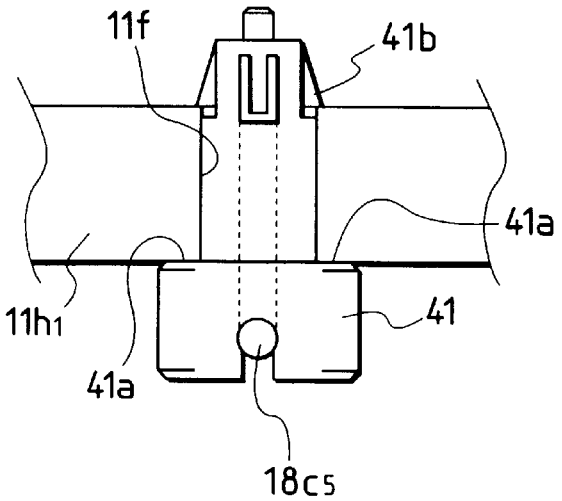
FIG. 25
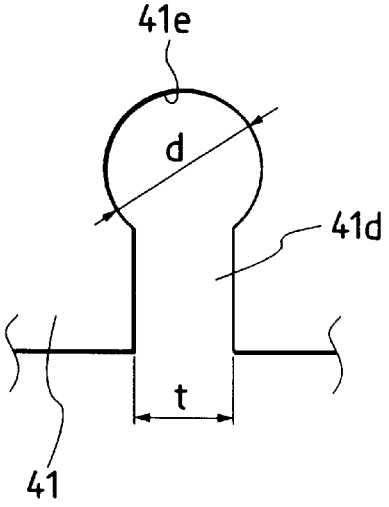

PROCESS CARTRIDGE AND ELECTROPHOTOGRAPHIC IMAGE FORMING APPARATUS

BACKGROUND OF THE INVENTION

1. Field of the Invention

The present invention relates to a process cartridge and an electrophotographic image forming apparatus. Here, the "electrophotographic image forming apparatus" is an apparatus for forming an image on a recording medium by using an electrophotographic image forming system. For example, the electrophotographic image forming apparatus may be an electrophotographic copying machine, an electrophotographic printer (for example, a laser beam printer or an LED printer), an electrophotographic facsimile or an electrophotographic word processor. The "process cartridge" incorporates therein an electrophotographic photosensitive member and at least one of a charge means, a developing means and a cleaning means as a cartridge unit which can detachably mounted to a main body of an electrophotographic image forming apparatus.

2. Related Background Art

A conventional electrophotographic image forming apparatus such as an electrophotographic copying machine, a laser beam printer or the like includes a photosensitive drum. Well-known processes such as charging, exposure and development is successively effected regarding the photosensitive drum, thereby forming a toner image on the photosensitive drum and transferring the toner image onto a recording medium. Thereafter, residual toner remaining on the photosensitive drum is removed by a cleaning device. In this way, the image is formed.

In such electrophotographic image forming apparatuses, recently, a process cartridge is adopted to make the apparatus compact and simplify the maintenance. In the process cartridge, the photosensitive drum and the process means (such as a charge member, a developing member and a cleaning member) acting on the photosensitive drum are integrally incorporated as a cartridge unit which can detachably mounted to a main body of the image forming apparatus by an operator himself.

In such a process cartridge, a cartridge frame is provided at its lower portion with an opening through which the photosensitive drum can be contacted with the recording medium being conveyed. In a condition that the process cartridge is dismounted from the main body of the image forming apparatus, by closing the opening by an open/close shutter member, the photosensitive drum is protected. The shutter member is normally connected to the cartridge frame via a connection member.

SUMMARY OF THE INVENTION

An object of the present invention is to provide a process cartridge which can effectively protect an electrophotographic photosensitive member by a shutter member, and an electrophotographic image forming apparatus to which such a process cartridge can detachably mounted.

Another object of the present invention is to provide a process cartridge in which a connection member for connecting a shutter member to a cartridge frame can easily be attached to the cartridge frame, and an electrophotographic image forming apparatus to which such a process cartridge can detachably mounted.

A further object of the present invention is to provide a process cartridge in which a connection member for connecting a shutter member to a cartridge frame is prevented from disengaging from the cartridge frame, and an electrophotographic image forming apparatus to which such a process cartridge can detachably mounted.

A still further object of the present invention is to provide a process cartridge in which a first connection member is prevented from disengaging from a cartridge frame by a second connection member, and an electrophotographic image forming apparatus to which such a process cartridge can detachably mounted. When the process cartridge is mounted to a main body of the image forming apparatus, the first connection member is contacted with an engagement member of the main body of the image forming apparatus so that the first connection member is subjected to a force for opening a shutter member from a protection position where an exposed portion of an electrophotographic photosensitive member is protected to a retract position.

A further object of the present invention is to provide a process cartridge detachably mountable to a main body of an electrophotographic image forming apparatus and having a cartridge frame, an electrophotographic photosensitive member, process means, a shutter member, a first connection member and a second connection member, and an electrophotographic image forming apparatus to which such a process cartridge can detachably mounted. The electrophotographic photosensitive member is supported by the cartridge frame, and the process means are supported by the cartridge frame and act on the electrophotographic photosensitive member.

The shutter member serves to protect a portion of the electrophotographic photosensitive member exposed from the cartridge frame.

The first connection member connects the cartridge frame to the shutter member. The first connection member can be rotated with respect to the cartridge frame and is detachably attached to the cartridge frame. Further, when the process cartridge is mounted to a main body of the image forming apparatus, the first connection member is contacted with an engagement member of a main body of the image forming apparatus so that the first connection member is subjected to a force for opening the shutter member from a protection position where an exposed portion of the electrophotographic photosensitive member is protected to a retract position.

The second connection member connects the cartridge frame to the shutter member. The second connection member can be rotated with respect to the cartridge frame and is attached to the cartridge frame in such a manner that movement of the second connection member along a rotational axis thereof is regulated. Further, the second connection member regulates movement of the first connection member in a direction that the first connection member is disengaged from the cartridge frame in order to prevent the first connection member from being disengaged from the cartridge frame.

The other objects and features of the present invention will be apparent from the following detailed explanation of the invention referring to the accompanying drawings.

BRIEF DESCRIPTION OF THE DRAWINGS

FIG. 23 is an exploded perspective view showing the third embodiment;

FIG. 24 is a horizontal sectional view showing the third embodiment; and

FIG. 25 is an enlarged view showing a portion of FIG. 24.

DETAILED DESCRIPTION OF THE PREFERRED EMBODIMENTS

The present invention will now be explained in connection with embodiment thereof with reference to the accompanying drawings.

First of all, a preferred embodiment of the present invention will be explained. In the following explanations, a "width-wise direction" of a process cartridge B means a direction along which the process cartridge is mounted to and dismounted from a main body 14 of an image forming apparatus and which coincides with a recording medium conveying direction. A "longitudinal direction" of the process cartridge B means a direction transverse (substantially perpendicular) to the direction along which the process cartridge is mounted to and dismounted from the main body 14, which longitudinal direction is parallel with a surface of the recording medium and is transverse (substantially perpendicular) to the recording medium conveying direction. Further, "left or right" with respect to the process cartridge means right or left when the recording medium is looked at from the above along the recording medium conveying direction.

Figure 1:
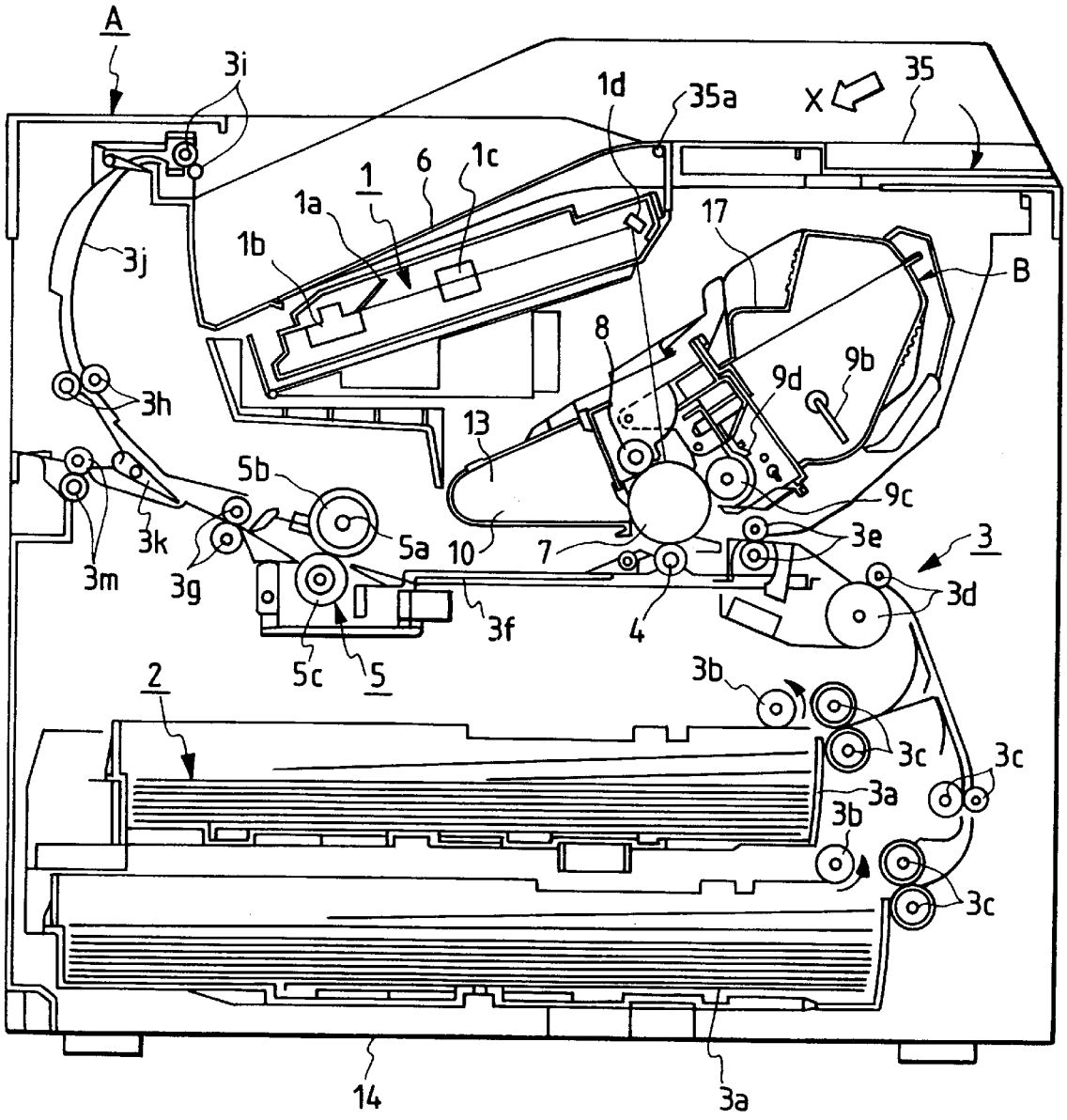
FIG. 1 is an elevational sectional view of an electrophotographic image forming apparatus according to a first embodiment of the present invention.
Figure 2:
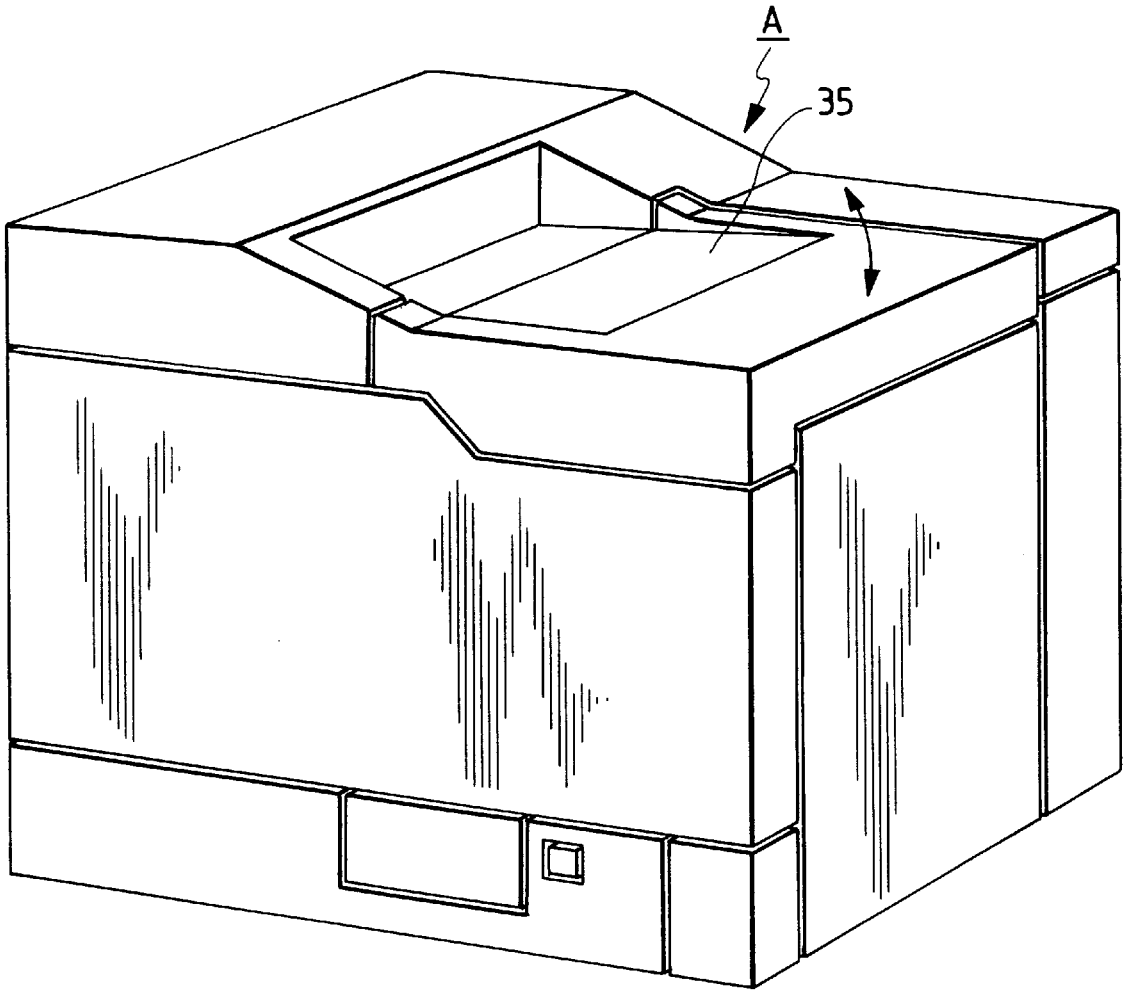
FIG. 2 is a perspective view of the image forming apparatus of FIG. 1.

FIG. 1 is an elevational sectional view of an electrophotographic image forming apparatus (laser beam printer) according to a first embodiment of the present invention, and FIG. 2 is a perspective view of the image forming apparatus. Further, FIGS. 3 to 8 show a process cartridge according to the first embodiment. Further, in the following explanations, an "upper surface" of the process cartridge B means a surface positioned upside when the process cartridge B is mounted to the main body 14 and a "lower surface" means a surface positioned downside when the process cartridge B is mounted to the main body 14.

(Electrophotographic Image Forming Apparatus A and Process Cartridge B)

Figure 3:
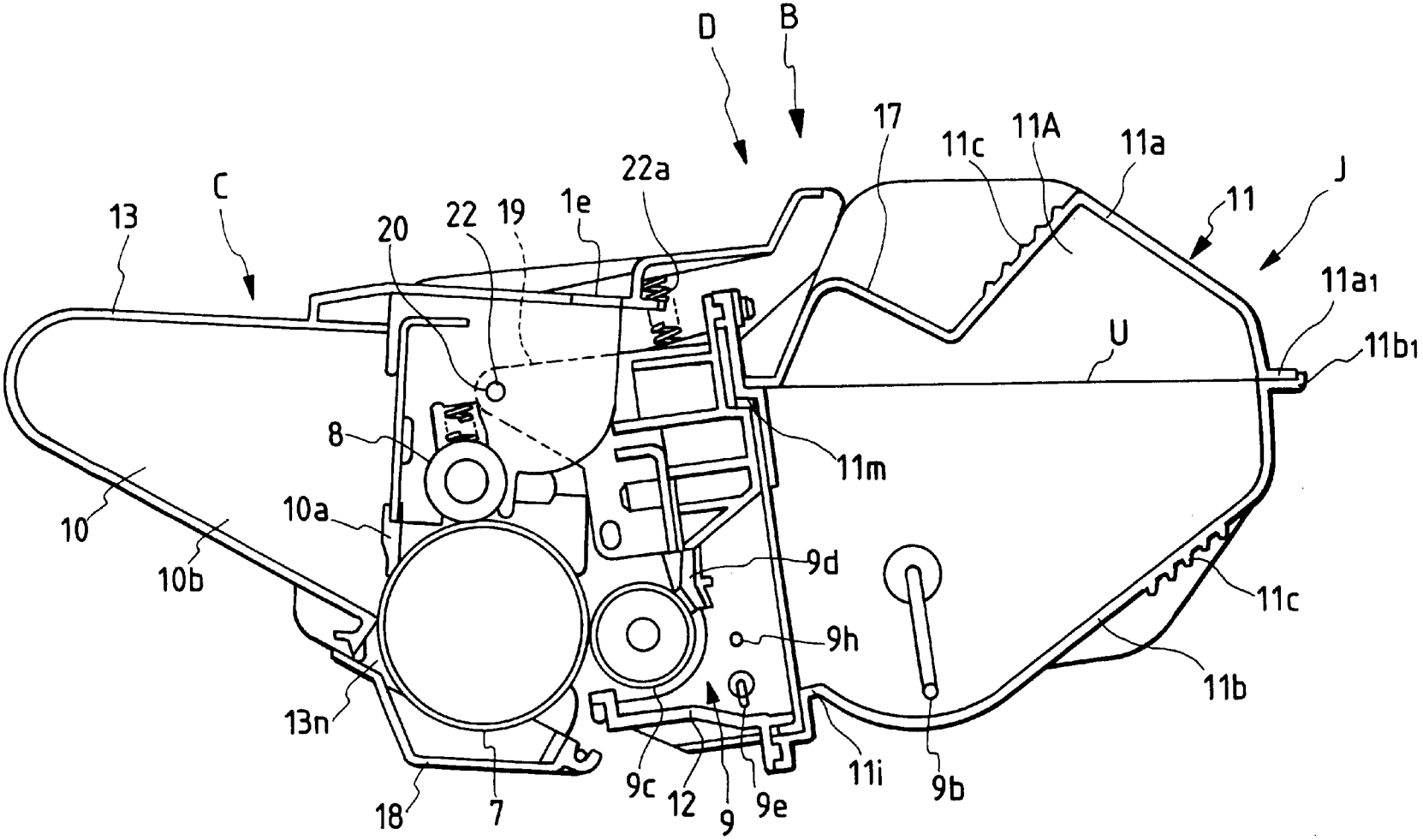
FIG. 3 is an elevational sectional view of a process cartridge.

First of all, the laser beam printer A will be explained with reference to FIGS. 1 and 2. Incidentally, FIG. 3 is a side view of the process cartridge B.

As shown in FIG. 1, the laser beam printer A serves to form an image on a recording medium (for example, a recording sheet, an OHP sheet, a cloth or the like) by using an electrophotographic image forming process. And, a toner image is formed on a drum-shaped electrophotographic photosensitive member (referred to as "photosensitive drum" hereinafter). More specifically, the photosensitive drum is firstly charged by a charge means, and then a latent image corresponding to image information is formed on the photosensitive drum by illuminating a laser beam (corresponding to image information) from an optical means onto the photosensitive drum, and then the latent image is developed by a developing means to form a toner image. In synchronous with the formation of the toner image, a recording medium 2 is picked up and conveyed from a sheet supply cassette 3*a* by means of a pick-up roller 3*b*, pairs of convey rollers 3*c*, 3*d* and a pair of regist rollers 3*e*. Then, the toner image formed on the photosensitive drum 7 of the process cartridge B is transferred onto the recording medium 2 by applying voltage to a transfer roller (transfer means) 4. Thereafter, the recording medium 2 to which the toner image was transferred is sent to a fixing means 5 through a convey guide 3*f*. The fixing means 5 includes a drive roller 5*c* and a fixing roller 5*b* having a heater 5*a* therein. While the recording medium 2 is passing between the rollers 5*b* and 5*c*, heat and pressure are applied to the recording medium, thereby fixing the toner image to the recording medium.

Thereafter, the recording medium 2 is conveyed through a reverse path 3*j* by means of pairs of discharge rollers 3*g*, 3*h* and 3*i*, and is discharged onto a discharge tray 6. The discharge tray 6 is provided on an upper surface of the main body 14 of the image forming apparatus A. Incidentally, by driving a rockable flapper 3*k*, the recording medium 2 can be discharged by a pair of discharge rollers 3*m* without through the reverse path 3*j*. In the illustrated embodiment, the pick-up roller 3*b*, pairs of convey rollers 3*c*, 3*d*, pair of regist rollers 3*e*, convey guide 3*f*, pairs of discharge rollers 3*g*, 3*h* and 3*i*, and pair of discharge rollers 3*m* constitute a convey means 3.

On the other hand, as shown in FIGS. 3 to 8, in the process cartridge B, the photosensitive drum 7 having a photosensitive layer is rotated and is uniformly charged by applying voltage to a charge roller (charge means) 8. Then, a latent image is formed by illuminating a laser beam corresponding to image information from an optical system 1 onto the photosensitive drum 7 through an exposure opening 1*e*, and the latent image is developed by a developing means 9 with toner as a toner image. The charge roller 8 is disposed in contact with the photosensitive drum 7 to charge the photosensitive drum 7. The charge roller 8 is rotatingly driven by rotation of the photosensitive drum 7. The developing means 9 serves to develop the latent image formed on the photosensitive drum 7 by supplying the toner to a developing area of the photosensitive drum 7. The optical system 1 includes a laser diode 1*a*, a polygon mirror 1*b*, a lens 1*c* and a reflection mirror 1*d*.

In the developing means 9, the toner contained in a toner container 11A is sent to a developing roller 9*c* by rotating a toner feed member 9*b*. While the developing roller 9*c* having a fixed magnet therein is being rotated, a toner layer is formed on the developing roller 9*c* by applying frictional charge by means of a developing blade 9*d*, and the toner layer is supplied to the developing area of the photosensitive drum 7. By transferring the toner onto the photosensitive drum 7 in correspondence to the latent image, the toner image (visualized image) is formed. The developing blade 9*d* serves to regulate a thickness of the toner layer around the developing roller 9*c* and apply the frictional charge to the toner. A toner agitating member 9*e* for circulating the toner in a developing chamber is rotatably supported in the vicinity of the developing roller 9*c*.

After the toner image formed on the photosensitive drum 7 is transferred onto the recording medium 2 by applying voltage having polarity opposite to that of the toner image to the transfer roller 4, residual toner remaining on the photosensitive drum 7 is removed by a cleaning means 10. In the cleaning means 10, the residual toner remaining on the photosensitive drum 7 is scraped by an elastic cleaning blade 10*a* contacted with the photosensitive drum 7 and the scraped toner is collected in a waste toner reservoir 10*b*.

The process cartridge B is formed by joining a toner frame 11 including the toner container (toner containing portion) 11A to a developing frame 12 holding the developing means 9 such as the developing roller 9*c*. And, a cleaning frame 13 holding the photosensitive drum 7, cleaning means 10 such as the cleaning blade 10*a* and charge roller 8 is also joined. The process cartridge B so formed can be mounted to and dismounted from the main body 14 of the image forming apparatus by the operator.

The process cartridge B is provided with the exposure opening 1*e* through which the laser beam corresponding to the image information is illuminated onto the photosensitive drum 7, and a transfer opening 13*n* through which the photosensitive drum 7 is contacted with the recording medium 2. More specifically, the exposure opening 1*e* is formed in the cleaning frame 13 and the transfer opening 13*n* is defined between the developing frame 12 and the cleaning frame 13.

Next, a housing of the process cartridge B according to the illustrated embodiment will be described.

The process cartridge B according to the illustrated embodiment has a housing obtained by joining the toner frame 11 and the developing frame 12 and by rotatably joining the cleaning frame 13. The photosensitive drum 7, charge roller 8, developing means 9 and cleaning means 10 are contained within the housing as a cartridge unit. The process cartridge B can detachably mounted to a cartridge mounting means of the main body 14 of the image forming apparatus.

(Housing of Process Cartridge B)

The process cartridge B according to the illustrated embodiment will now be described.

As shown in FIG. 3, the toner feed member 9*b* is rotatably attached to the toner frame 11. The developing roller 9*c* and the developing blade 9*d* are attached to the developing frame 12, and the agitating member 9*e* for circulating the toner in the developing chamber is rotatably attached in the vicinity of the developing roller 9*c*. Further, as shown in FIG. 3, an antenna rod 9*h* extending a longitudinal direction of the developing roller 9*c* is attached to the developing frame 12 in parallel with the developing roller 9*c*. A toner developing unit (integral second frame) D is formed by welding the toner frame 11 and the developing frame 12 together (by supersonic welding in the illustrated embodiment).

A drum shutter device 18 for covering the photosensitive drum 7 when the process cartridge B is dismounted from the main body 14 to protect the photosensitive drum against long term exposure and contact with foreign matters is attached to the cartridge frame (11, 12) constituting the toner developing unit D.

Figure 4:
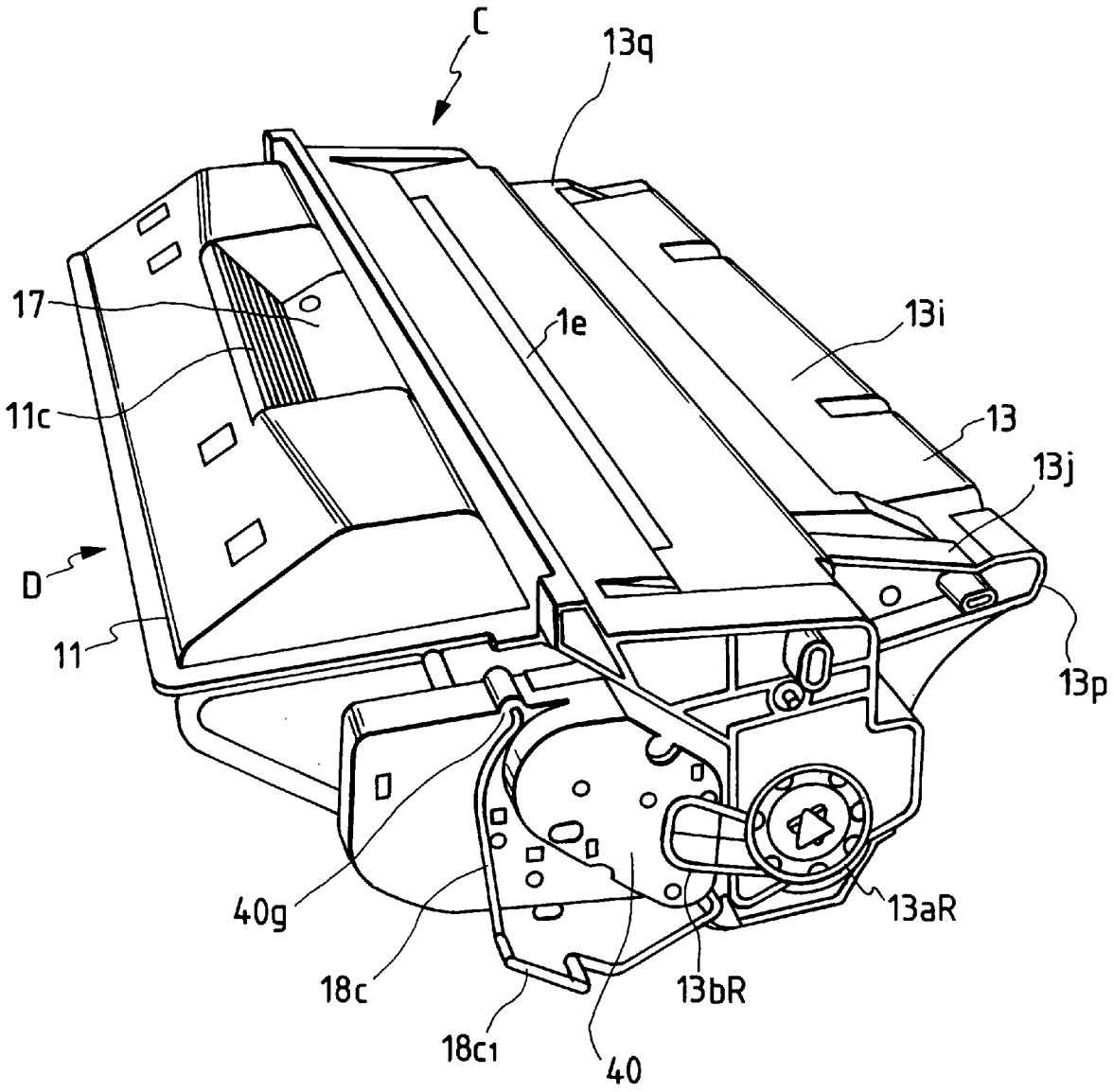
FIG. 4 is a perspective view of the process cartridge of FIG. 3 looked at from the right and above.
Figure 5:
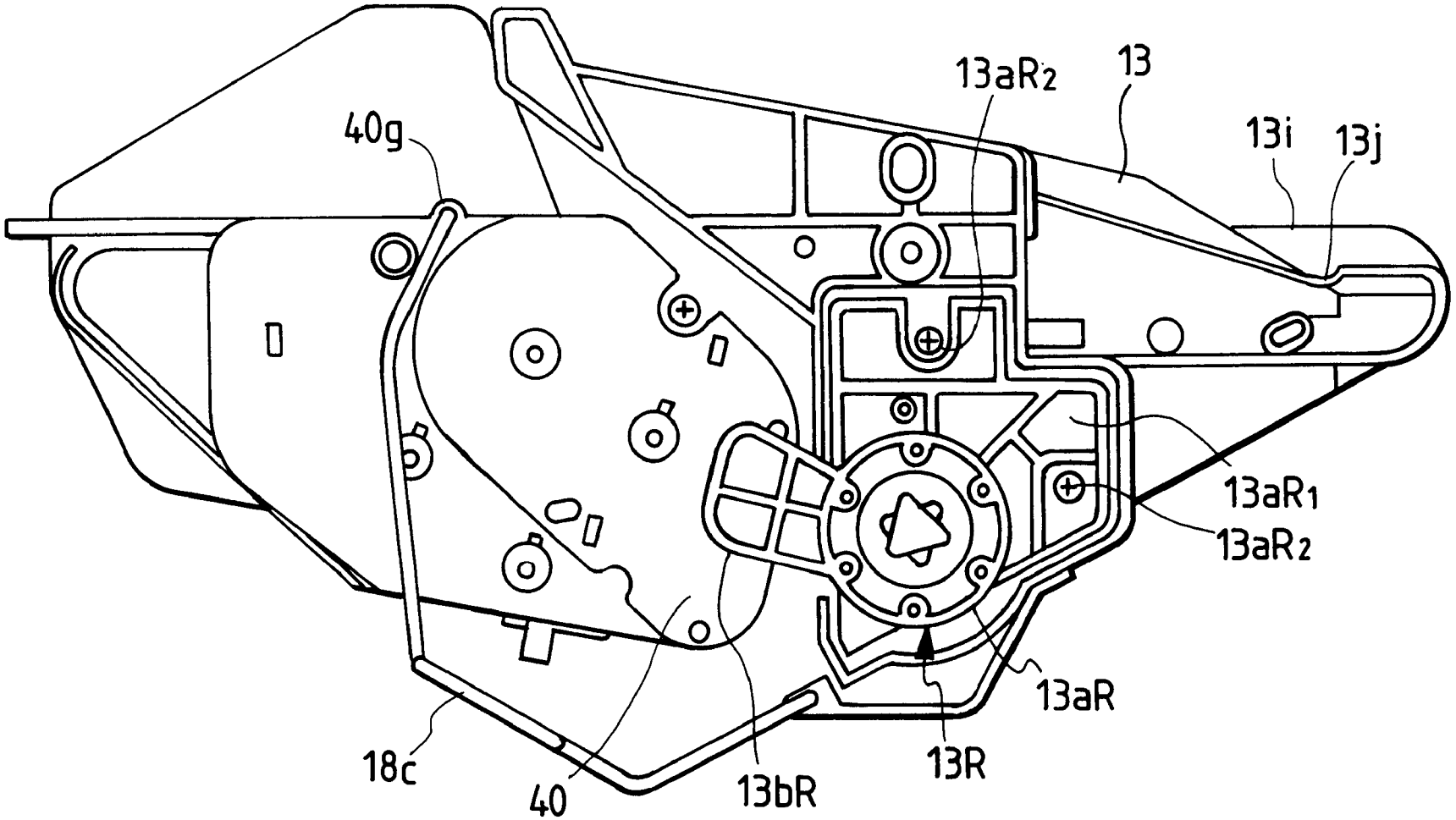
FIG. 5 is a right side view of the process cartridge of FIG. 3.
Figure 6:
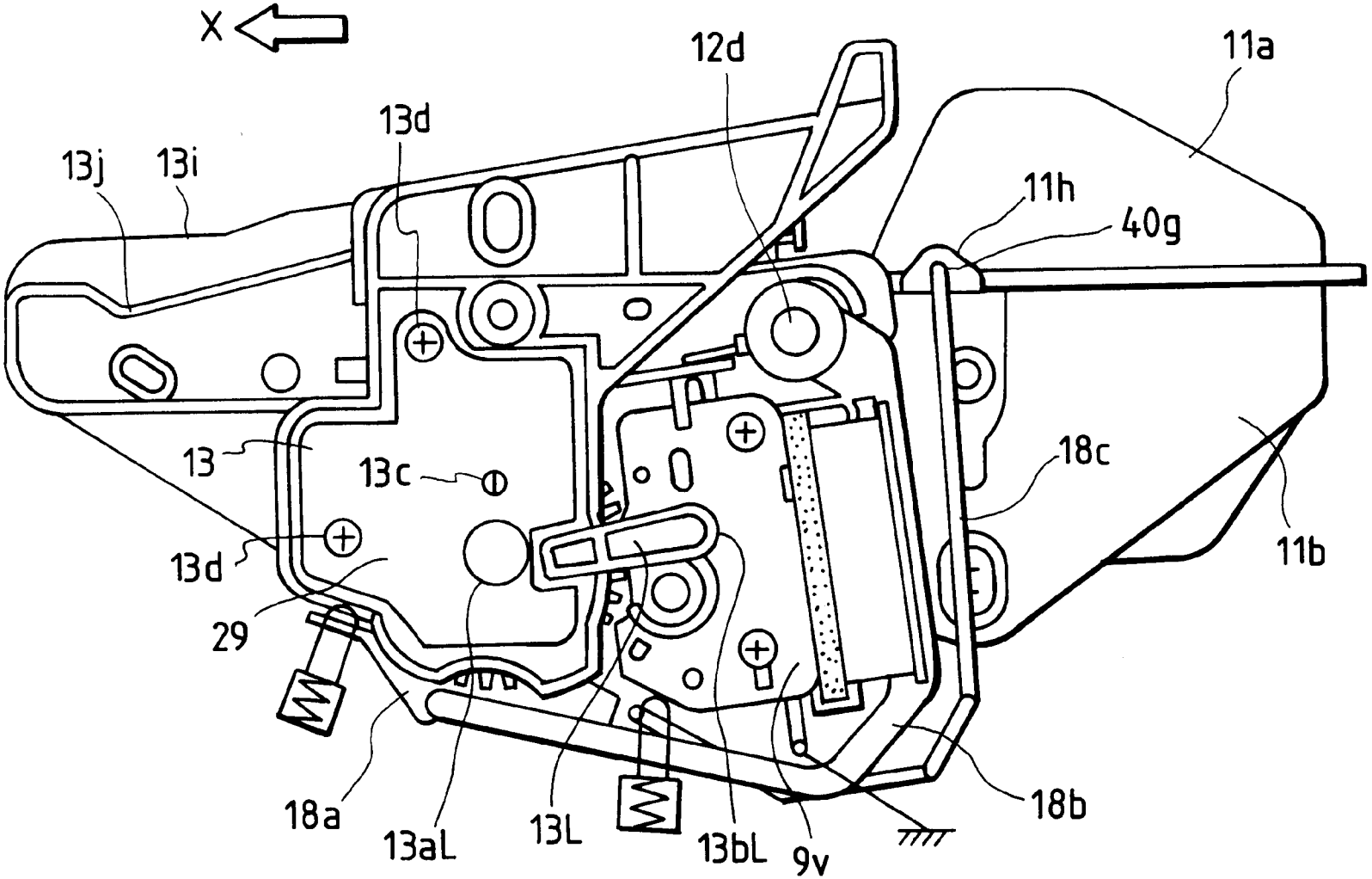
FIG. 6 is a left side view of the process cartridge of FIG. 3.
Figure 7:
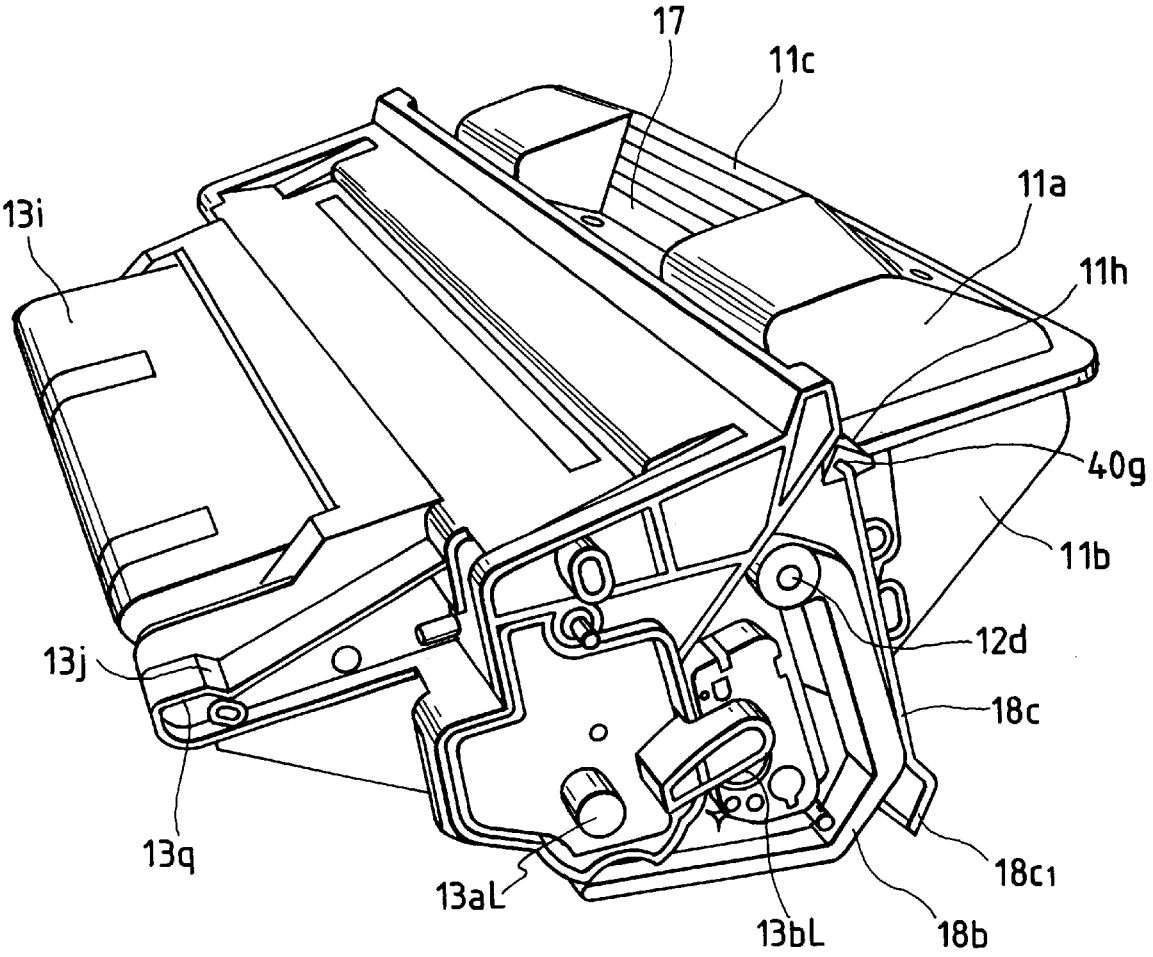
FIG. 7 is a perspective view of the process cartridge of FIG. 3 looked at from the left and above.
Figure 8:
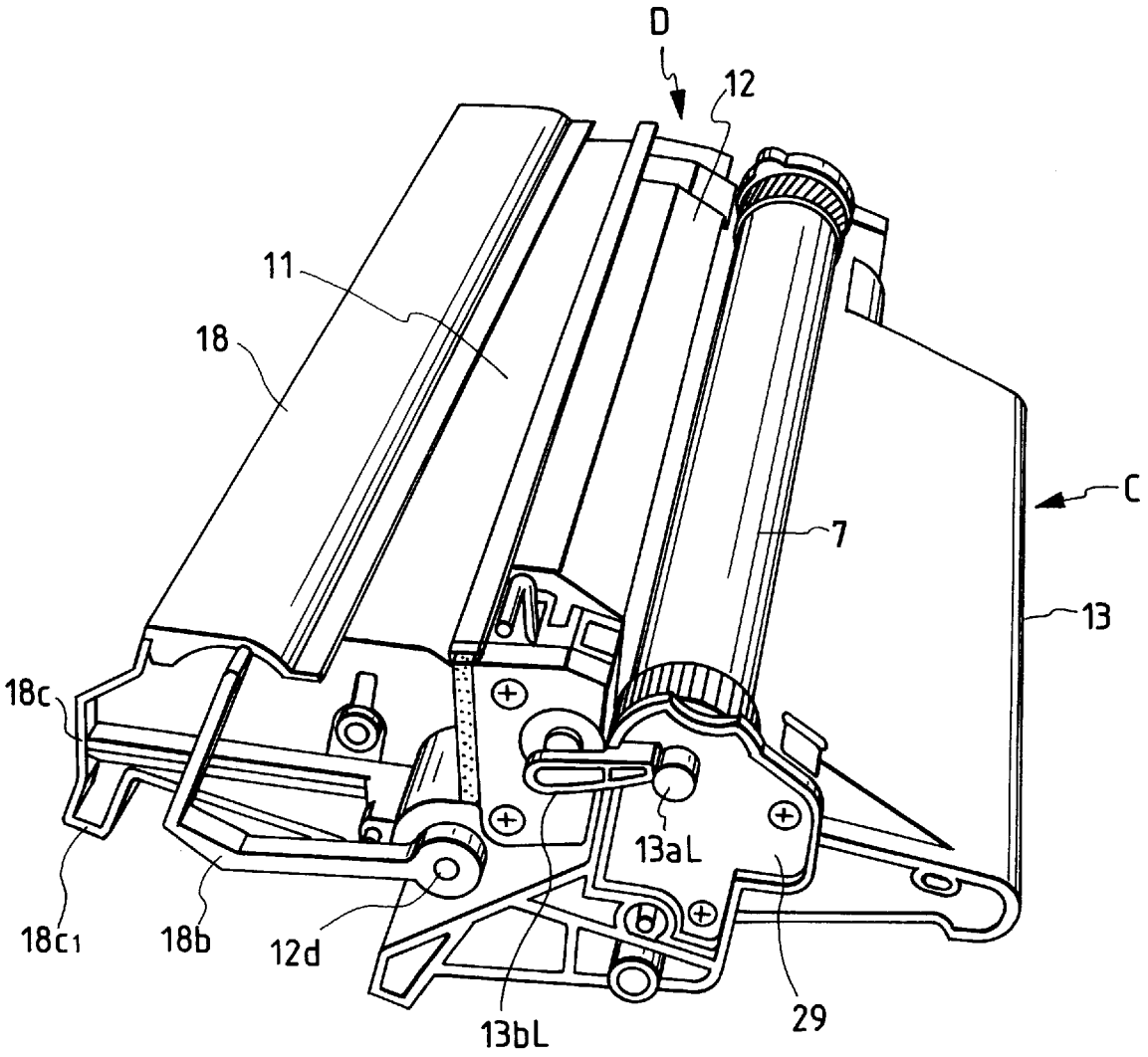
FIG. 8 is a perspective view showing a left and lower portion of the process cartridge of FIG. 3.

As shown in FIG. 6, the shutter device 18 comprises a drum shutter 18*a* for opening and closing the transfer opening 13*n* shown in FIG. 3, a shutter arm 18*b* acting as a link for supporting the drum shutter 18*a*, and shutter rods 18*c*. As shown in FIGS. 4 and 5, regarding both longitudinal ends of the shutter 18*a* at an upstream side in a conveying direction of the recording medium 2, one end of the right shutter rod 18*c* is rotatably received in a hole of a developing holder 40 to form a rotary portion 40*g*. Further, as shown in FIGS. 6 and 7, one end of the left shutter rod 18*c* is rotatably received in a boss 11*h* provided on a lower frame 11*b* of the toner frame 11 to form a rotary portion 40*g*. The other ends of both shutter rods 18*c* are rotatably attached at an upstream side of the drum shutter 18*a* in a mounting direction of the process cartridge B. The shutter rods 18*c* are formed from metal rods. Although portions of the shutter rods rotatably attached to the drum shutter 18*a* are integrally connected together, such portions may be independently attached to the drum shutter. The shutter arm 18*b* is formed from synthetic resin and is provided only at one side of the drum shutter 18*a*. One end of the shutter arm is rotatably attached to the drum shutter 18*a* at a downstream side of the position where the shutter rods 18*c* are rotatably attached to the shutter 18*a*, in a conveying direction of the recording medium 2. The other end of the shutter arm is rotatably attached to a holder provided on the developing frame 12 as a rotary portion 12*d*.

The shutter arm 18*b* has a length different those of the shutter rods 18*c*, and the shutter arm, shutter rods, drum shutter 18*a* and the cartridge frame (toner frame 11 and developing frame 12) constitute a plane quadric link mechanism. Laterally protruding portions (projections) 18*cl* provided on both shutter rods 18*c* abut against fixed members (not shown) provided in the vicinity of a cartridge mounting space S of the main body 14, so that, when the process cartridge B is shifted, the shutter device 18 is operated to open the drum shutter 18*a*. That is to say, in the plane quadric link mechanism, the shutter rods 18*c* act as main links, the shutter arm 18*b* and the drum shutter 18*a* act as driven links, and the cartridge frame acts as a fixed link.

The drum shutter device 18 comprised of the drum shutter 18*a*, shutter arm 18*b*, shutter rods 18*c* and cartridge frame (11, 12) is inserted into the rotary portion 12*d*. The drum shutter 18*a* is biased to cover or close the transfer opening 13*n* by means of a torsion coil spring (not shown) having one end locked to the shutter arm 18*b* and the other end locked to the developing frame 12. In the condition that the process cartridge B is positioned out of the main body 14 in which the projections 18*cl* of the shutter rods 18*c* are not restricted, the transfer opening 13*n* is covered by the drum shutter 18*a* to protect the photosensitive drum 7.

Further, as shown in FIG. 3, the photosensitive drum 7, charge roller 8 and cleaning means 10 are attached to the cleaning frame 13 to form a cleaning unit (first frame) C.

By rotatably joining the toner developing unit D and the cleaning unit C together by means of round pin connection members 22, the process cartridge B is completed. That is to say, circular rotary holes 20 (in parallel with the developing roller 9*c*) are formed in tip end portions of arm portions 19 provided at both sides of the developing frame 12 in the longitudinal direction thereof (axial direction of the developing roller 9*c*). On the other hand, two recessed portions for receiving the arm portions 19 are provided at both sides of the cleaning frame 13 in the longitudinal direction thereof. The arm portions 19 are inserted into the recessed portions, and the connection members 22 are press-fitted in attachment holes of the cleaning frame 13 and are inserted into the rotary holes 20 of the arm portions 19 and then are press-fitted in the other attachment holes of the cleaning frame. In this way, the toner developing unit D and the cleaning unit C are rotatably joined together for rotational movement around the connection members 22. In this case, compression springs 22*a* attached to bosses formed on root portions of the arm portions 19 abut against upper walls of the recessed portions into which the arm portions 19 of the cleaning frame are inserted, so the developing frame 12 is biased downwardly by the compression springs 22*a*, thereby urging the developing roller 9*c* against the photosensitive drum 7 positively.

(Guide Means for Process Cartridge)

Figure 9:
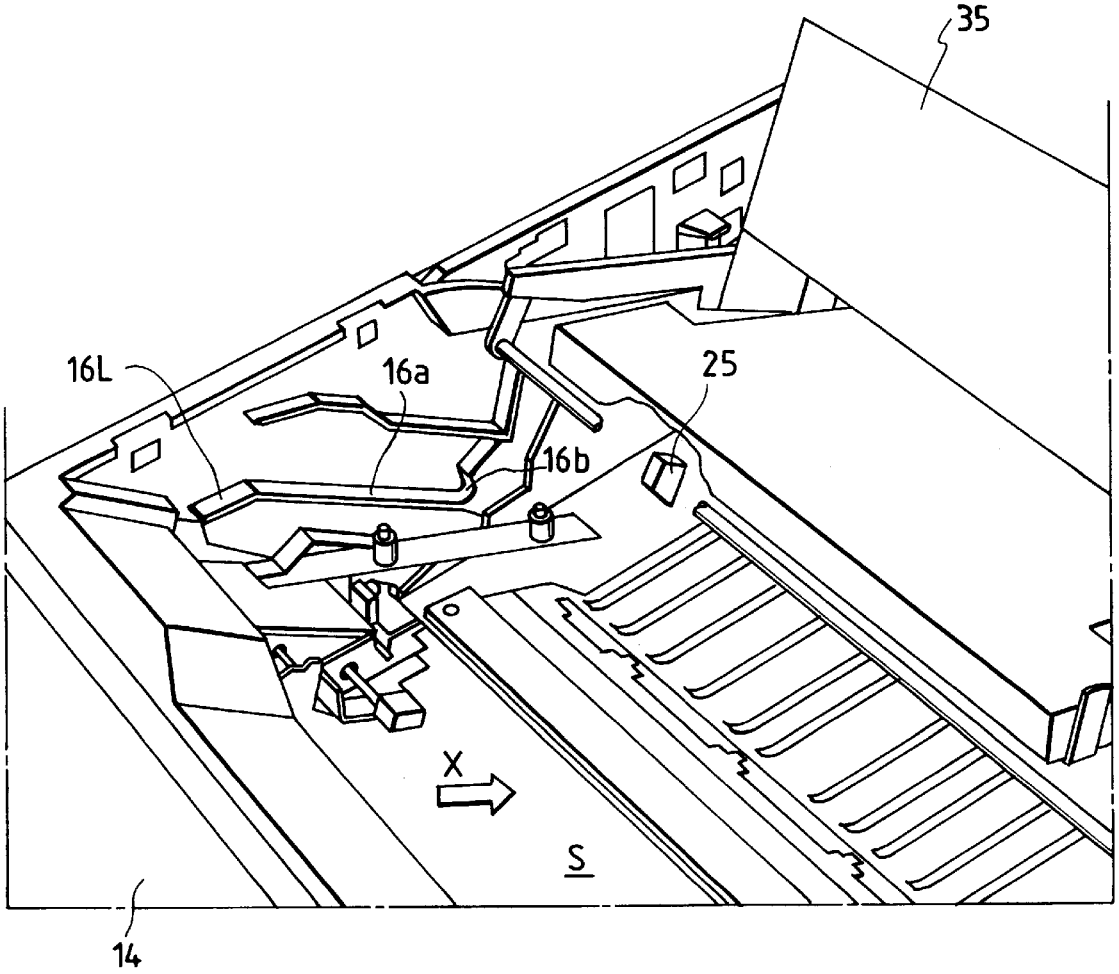
FIG. 9 is a perspective view of a process cartridge mounting portion of a main body of the image forming apparatus.
Figure 10:
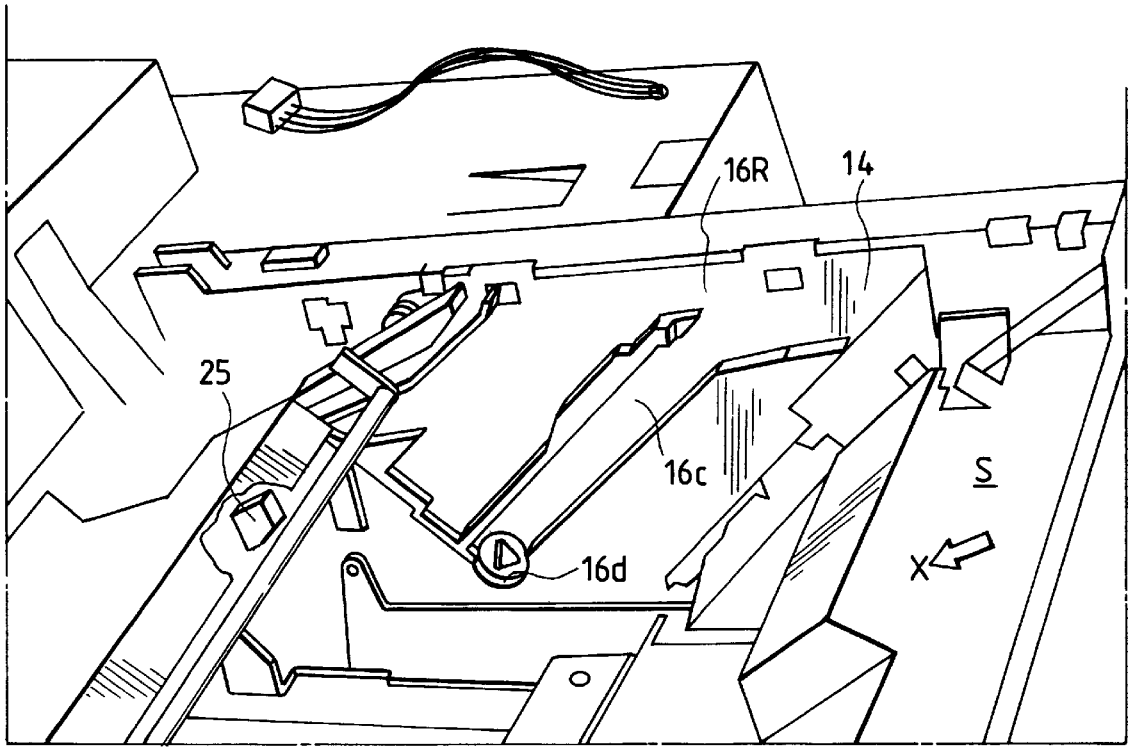
FIG. 10 is a perspective view of the process cartridge mounting portion of the main body of the image forming apparatus.

Next, a guide means for guiding the process cartridge B when the latter is mounted to and dismounted from the main body 14 of the image forming apparatus will be explained with reference to FIGS. 9 and 10.

As shown in FIGS. 4 to 7, the cleaning frame 13 is provided at its both outer side surfaces with guide means acting as guides when the latter is mounted to and dismounted from the main body 14 of the image forming apparatus. The guide means comprises cylindrical guides (positioning guide members) 13*a*R, 13*aL*, and rotation prevention guides (guide members acting as posture maintaining means during the mounting and dismounting) 13*b*R, 13*b*L.

As shown in FIG. 5, the cylindrical guide 13*a*R is a hollow cylindrical member, and the rotation prevention guide 13*b*R is formed integrally with the cylindrical guide 13*a*R to protrude from an outer peripheral surface of the cylindrical guide 13*a*R substantially radially. An attachment flange 13*a*R1 is integrally formed on the cylindrical guide 13*a*R. The right guide member 13R having the cylindrical guide 13*a*R, rotation prevention guide 13*b*R and attachment flange 13*a*R1 is secured to the cleaning frame 13 by inserting small screws 13*a*R2 into threaded holes of the attachment flange 13*a*R1 and threading into the cleaning frame 13. The rotation prevention guide 13*b*R of the right guide member 13R secured to the cleaning frame 13 is positioned at a side surface of the developing frame 12 to extend laterally of the developing holder 40 secured to the developing frame 12.

As shown in FIG. 6, a flat flange 29 is provided on a left side surface of the cleaning frame. The flange 29 is fitted on a positioning pin 13*c* not to be rotated and is secured to the cleaning frame 13 by small screws 13*d*. The cylindrical guide 13*a*L coaxial with the photosensitive drum 7 is protruded from the flange 29 outwardly (toward this side of the plane of FIG. 6).

As shown in FIG. 6, the elongated rotation prevention guide 13*b*L is formed integrally with the cleaning frame 13 to protrude laterally of the cleaning frame 13 in a substantially radial direction of the cylindrical guide 13*a*L in a slightly spaced relation to the cylindrical guide 13*a*L. A portion of the flange 29 which interferes with the rotation prevention guide 13*b*L is cut away, and a lateral protruding amount of the rotation prevention guide 13*b*L is selected so that a bottom of the cut-away portion substantially coincides with the top of the rotation prevention guide 13*b*L. The rotation prevention guide 13*b*L extends laterally of a developing roller bearing box 9*v* secured to the developing frame 12. In this way, the left guide member 13L is constituted by different parts, i.e., metallic cylindrical guide 13*a*L and synthetic resin rotation prevention guide 13*b*L.

Next, regulation abutment portions 13*j* provided on an upper surface 13*i* of the cleaning unit C will be explained. Here, the "upper surface" means a surface positioned upside when the process cartridge B is mounted to the main body 14 of the image forming apparatus.

In the illustrated embodiment, as shown in FIGS. 4 to 7, the regulation abutment portions 13*j* are provided on the upper surface 13*i* of the cleaning unit C at a right side end 13*p* and a left side end 13*q* thereof in a direction perpendicular to a process cartridge mounting direction. The regulation abutment portions 13*j* serve to regulate the position of the process cartridge B when the process cartridge B is mounted to the main body 14 of the image forming apparatus. That is to say, when the process cartridge B is mounted to the main body 14 of the image forming apparatus, the regulation abutment portions 13*j* abut against fixed members 25 (refer to FIGS. 9 and 10) provided on the main body 14, thereby regulation rotation of the process cartridge B around the cylindrical guides 13*a*R, 13*a*L.

Next, guide means of the main body 14 will be explained. When an open/close member 35 of the main body 14 is rotated in an anti-clockwise direction (FIG. 1) around a fulcrum 35*a*, an upper part of the main body 14 is opened to expose the process cartridge mounting portion as shown in FIGS. 9 and 10. A guide member 16L (FIG. 9) and a guide member 16R (FIG. 10) are provided on left and right inner walls of the main body 14 looked at from the process cartridge mounting direction.

The guide members 16L, 16R have inclined guide portions 16*a*, 16*c* inclined forwardly downwardly looked at from the process cartridge mounting (inserting) direction X, and semi-circular positioning recesses 16*b*, 16*d* contiguous to the guide portions 16*a*, 16*c* to just receive the cylindrical guides 13*a*L, 13*a*R of the process cartridge B. The positioning recesses 16*b*, 16*d* have semi-cylindrical inner peripheral surfaces and centers aligned with centers of the cylindrical guides 13*a*L, 13*a*R (and, accordingly, a center line of the photosensitive drum 7 when the process cartridge is mounted to the main body 14).

Widths of the guide portions 16*a*, 16*c* are selected to freely receive the cylindrical guides 13*a*L, 13*a*R in the process cartridge mounting direction. Thus, the rotation prevention guides 13*b*R, 13*b*L having widths smaller than diameters of the cylindrical guides 13*a*R, 13*a*L are loosely received in the guide portions 16*c*, 16*a*. The rotations of the cylindrical guides 13*a*L, 13*a*R and the rotation prevention guides 13*b*L, 13*b*R are regulated by the guide portions 16*a*, 16*c*, so the process cartridge B is mounted with maintaining its posture within a predetermined range. In the condition that the process cartridge B is mounted to the main body 14, the cylindrical guides 13*a*L, 13*a*R of the process cartridge B are received in the positioning recesses 16*b*, 16*d* of the guide members 13L, 13R and the left and right regulation abutment portions 13*j* of the top end of the cleaning frame 13 of the process cartridge B abut against the fixed members 25 of the main body 14.

In the above-mentioned process cartridge B, a weight at the cleaning unit C with respect to a center line connecting between the centers of the cylindrical guides 13$a$R and 13$a$L and a weight at the toner developing unit D with respect to the center line are selected so that, when the center line is maintained horizontally, primary moment of the toner developing unit D side becomes greater than primary moment of the cleaning unit C side.

When the process cartridge B is mounted to the main body 14 by the operator, the operator grips ribs 11$c$ on a recessed portion 17 and ribs on an underside of the toner frame 11 by his one hand and inserts the cylindrical guides 13$a$L, 13$a$R into the guide portions 16$a$, 16$c$ of the cartridge mounting portion of the main body 14 of the image forming apparatus. Then, the rotation prevention guides 13$b$L, 13$b$R are inserted into the guide portions 16$a$, 16$c$ of the main body 14 while inclining the process cartridge forwardly and downwardly in the process cartridge inserting direction. When the process cartridge is further inserted, the cylindrical guides 13$a$L, 13$a$R and the rotation prevention guides 13$b$L, 13$b$R of the process cartridge B are further advanced along the guide portions 16$a$, 16$c$ of the main body 14. When the cylindrical guides 13$a$L, 13$a$R of the process cartridge B reach the positioning recessed 16$b$, 16$d$ of the main body 14, the cylindrical guides 13$a$L, 13$a$R are seated within the positioning recessed 16$b$, 16$d$ by the weight of the process cartridge B itself.

In this way, the cylindrical guides 13$a$L, 13$a$R of the process cartridge B are accurately positioned with respect to the positioning recesses 16$b$, 16$d$. Since the center line connecting between the centers of the cylindrical guides 13$a$R and 13$a$L coincides with the center line of the photosensitive drum 7, the photosensitive drum 7 is substantially positioned with respect to the main body 14. Ultimately, the photosensitive drum 7 is correctly positioned with respect to the main body 14 after the coupling is completed.

In this condition, the regulation abutment portions 13$j$ of the process cartridge B are slightly spaced apart from the fixed members 25 of the main body 14. When the operator releases the process cartridge B, the toner developing unit D of the process cartridge B is rotated downwardly around the cylindrical guides 13$a$R, 13$a$L and the cleaning unit C is lifted. As a result, the regulation abutment portions 13$j$ of the process cartridge B abut against the fixed members 25 of the main body 14, thereby correctly mounting the process cartridge B with respect to the main body 14 of the image forming apparatus. Thereafter, the open/close member 35 is closed by rotating it around the fulcrum 35$a$ in a clockwise direction (FIG. 1).

In order to dismount the process cartridge B from the main body 14, the above-mentioned operations are effected reversely. First of all, the open/close member 35 of the main body 14 is opened and the operator lifts the process cartridge by gripping the upper and lower ribs 11$c$ (grip portion). As a result, the cylindrical guides 13$a$L, 13$a$R of the process cartridge B are rotated around the positioning recesses 16$b$, 16$d$ of the main body 14, thereby separating the regulation abutment portions 13$j$ of the process cartridge B from the fixed member 25 of the main body 14. Then, when the operator pulls the process cartridge B, the cylindrical guides 13$a$L, 13$a$R are disengaged from the positioning recesses 16$b$, 16$d$ to be moved toward the guide portions 16$a$, 16$c$ of the guide members 16L, 16R secured to the main body 14. When the process cartridge B is further pulled, the cylindrical guides 13$a$L, 13$a$R and the rotation prevention guides 13$b$L, 13$b$R of the process cartridge B are lifted while moving along the guide portions 16$a$, 16$c$. In this way, the posture of the process cartridge B is regulated, and, the process cartridge B is dismounted from the main body 14 without interfering with other elements.

When the process cartridge B is mounted to the main body 14 as mentioned above, the shutter device 18 is operated to open the transfer opening 13$n$. When the process cartridge B is dismounted from the main body 14, the shutter device 18 is operated to close the transfer opening 13$n$. Explaining the operation of the shutter device 18, first of all, when the process cartridge B is mounted to the main body, the projections 18$cl$ provided on the shutter robs 18$c$ abut against the fixed members (not shown) in the vicinity of the guide member 16R in the cartridge mounting portion to be stopped. Then, the shutter robs 18$c$ are rotated around the rotary portions 40$g$ in an anti-clockwise direction (FIG. 6), so the drum shutter 18$a$ is pulled to the right (FIG. 6) by the shutter rods, thereby opening the drum shutter. In this case, the other end of the drum shutter 18$a$ having one end rotatably attached to the shutter rods 18$c$ is supported by the tip end of the shutter arm 18$b$ rotated around the rotary portion 12$d$.

(Toner Frame)

Now, the toner frame will be fully explained with reference to FIGS. 3, 4, 5 and 7.

As shown in FIG. 3, the toner frame 11 is constituted by two parts, i.e., an upper frame 11$a$ and a lower frame 11$b$. As shown in FIG. 1, the upper frame 11$a$ extends upwardly to occupy a space at the right of the optical system 1 in the main body 14. With this arrangement, an amount of toner in the process cartridge B can be increased without making the image forming apparatus A bulky. As shown in FIGS. 3, 4 and 7, the recessed portion 17 acting as a grip is formed in a longitudinal central portion of the upper frame 11$a$. Thus, the operator can transport the process cartridge by gripping the recessed portion 17 of the upper frame and an under surface of the lower frame 11$b$. The longitudinal ribs 11$c$ formed within the recessed portion 17 and on the under surface of the lower frame 11$b$ act as slip preventing means when the operator grips the process cartridge B. As shown in FIG. 3, a flange 11$al$ of the upper frame 11$a$ is contacted with a flange (having a peripheral ridge) 11$bl$ of the lower frame 11$b$ at a welding surface U, and the frames 11$a$, 11$b$ are integrally joined together by melting and welding weld ribs on the welding plane U by supersonic welding. The joining method is not limited to the supersonic welding, but, for example, thermal welding, forced vibration or adhesive may be used. When the frames 11$a$, 11$b$ are joined together by the supersonic welding, the frames 11$a$, 11$b$ are supported by the flange 11$bl$ and by a stepped portion 11$m$ positioned within an opening portion 11$i$ substantially in flush with the flange 11$bl$.

Before the frames 11$a$, 11$b$ are joined together, the toner feed member 9$b$ is incorporated into the lower frame 11$b$. The opening portion 11$i$ for feeding the toner from the toner frame 11 to the developing frame 12 is formed along the longitudinal direction of the toner frame 11, and a seal is provided to close the opening portion 11$i$. Thereafter, the toner is loaded to from a toner unit J. The toner unit J is joined to the developing frame 12 by supersonic welding to form the toner developing unit D. The joining method is not limited to the supersonic welding, but, for example, adhesive or snap fit (utilizing an elastic force) may be used.

(Shutter Device)

Figure 11:
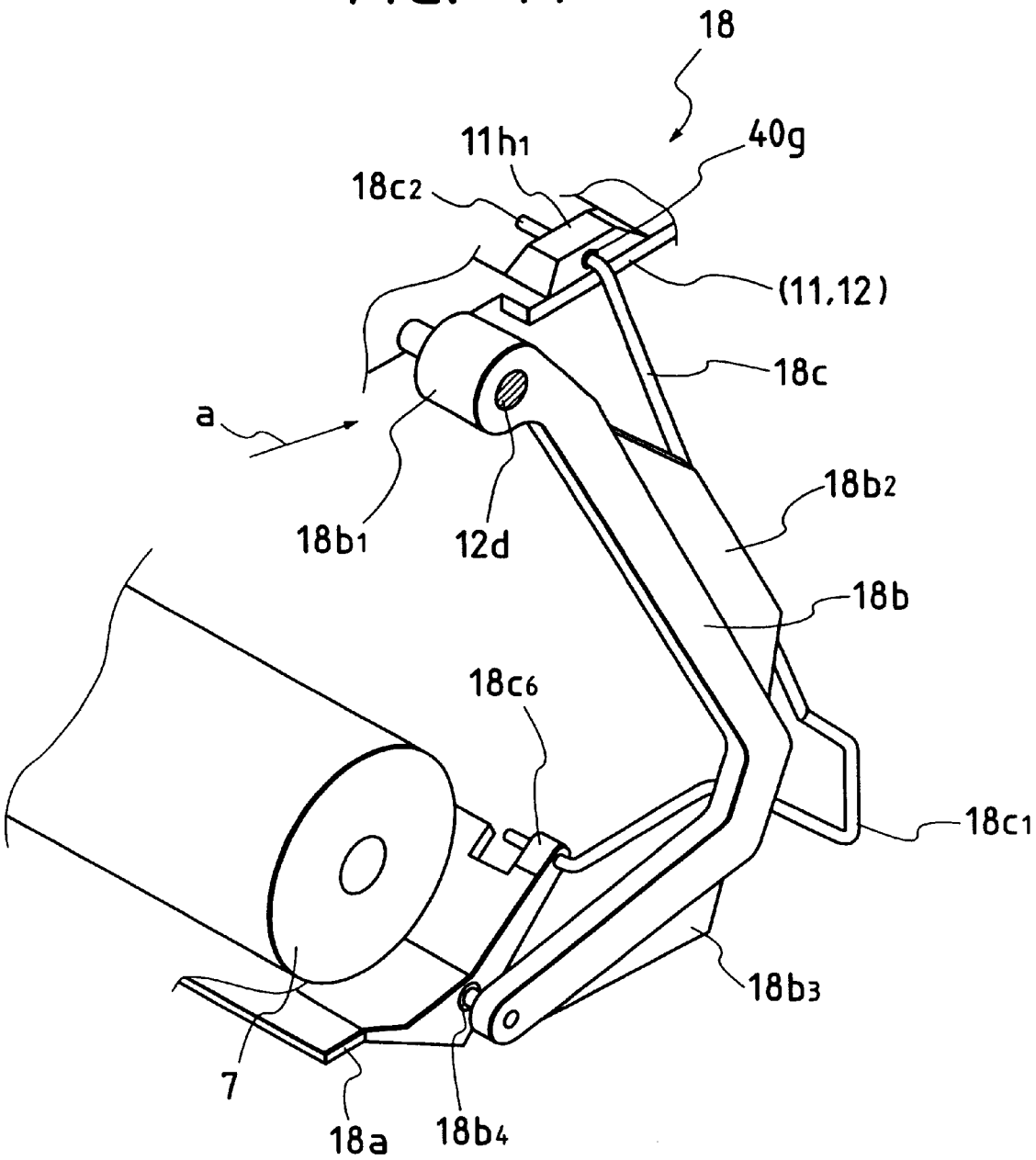
FIG. 11 is a perspective view of a shutter device according to the first embodiment.

The shutter device of the process cartridge according to the present invention is shown in FIG. 11.

As mentioned above, the shutter device 18 comprises the shutter rods 18$c$ bent to a substantially V-shape, the shutter arm 18$b$ bent similar to the shutter rods 18$c$, and the drum shutter 18*a* bent to substantially follow the outer surface of the photosensitive drum 7. The shutter rods 18*c* and the shutter arm 18*b* are rotatably supported by the cartridge frame (11, 12) for rotational movements around the rotary portions 40*g*, 12*d*, respectively.

Each shutter rod 18*c* is formed by bending a steel wire having a diameter of 2 mm. As shown in FIG. 11, at the rotary portion 40*g* for the right shutter rod 18*c*, the end of the shutter rod 18*c* is inserted into a boss 11*h* (left boss is designated by 11*h*1 and right boss is designated by 11*h*2) of the cartridge frame to form a rotary shaft 18*c*2 extending in a direction perpendicular to the plane of FIG. 11.

Figure 13:
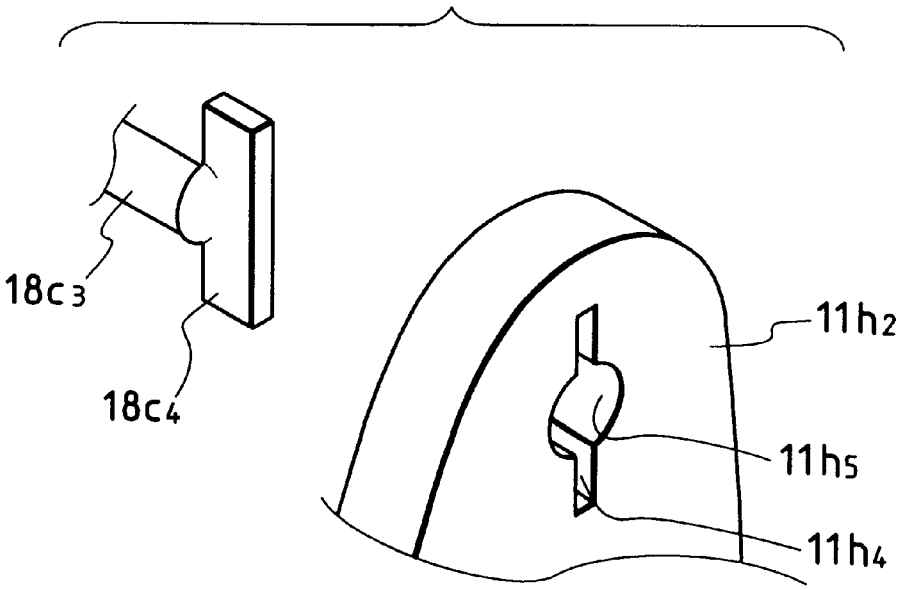
FIG. 13 is an exploded perspective view showing the other side support mechanism of a shutter rod.

As shown in FIG. 13, the other shutter rod, i.e., left shutter rod 18*c* has a rotary shaft 18*c*3 coaxial with the right rotary shaft 18*c*2. Similar to the rotary shaft 18*c*2, the rotary shaft 18*c*3 is a cylindrical shaft, but, the tip end of the 18*c*3 is flattened to form a flat portion 18*c*4; whereas, the rotary shaft 18*c*2 has no flat portion. A circular hole 11*h*5 for rotatably receiving the rotary shaft 18*c*3 is formed in the boss 11*h*2 formed on the toner lower frame 11*b*. And, slits 11*h*4 diametrically opposed to each other are formed in the circular hole 11*h*5 so that the flat portion 18*c*4 can pass through the slits.

During the normal opening and closing operations of the drum shutter device 18, i.e., within the range where the shutter rods 18*c* abut against the fixed member in the cartridge mounting portion to open the drum shutter 18*a*, the flat portion 18*c*4 of the shutter rod 18*c* is crossed with the slits 11*h*4, so the rotary shaft 18*c*3 of the shutter rod 18*c* cannot be disengaged from the cartridge frame (11, 12). However, if the drum shutter 18*a* is excessively opened, the flat portion 18*c*4 is aligned with the slits 11*h*4, thereby permitting the assembling and disassembling between the drum shutter device and the cartridge frame.

In the example shown in FIG. 11, the both shutter rods 18*c* have coaxial longitudinal ends constituting rotary shafts 18*c*6 rotatably attached to both longitudinal end surfaces of the drum shutter 18*a*. The shutter arm 18*b* is molded from resin, and, at the rotary portion 12*d*, a rotary shaft provided on the cartridge frame (11, 12) is press-fitted into the shutter arm, so that the shutter arm 18*b* cannot be shifted with respect to the cartridge frame (11, 12) at the rotary portion 12*d* in the direction perpendicular to the plane of FIG. 11.

Next, an arrangement in which the shutter arm 18*b* of the shutter device is attached to the cartridge frame in such a manner that the shutter arm cannot be moved longitudinal direction with respect to the cartridge frame will be explained.

Figure 12:
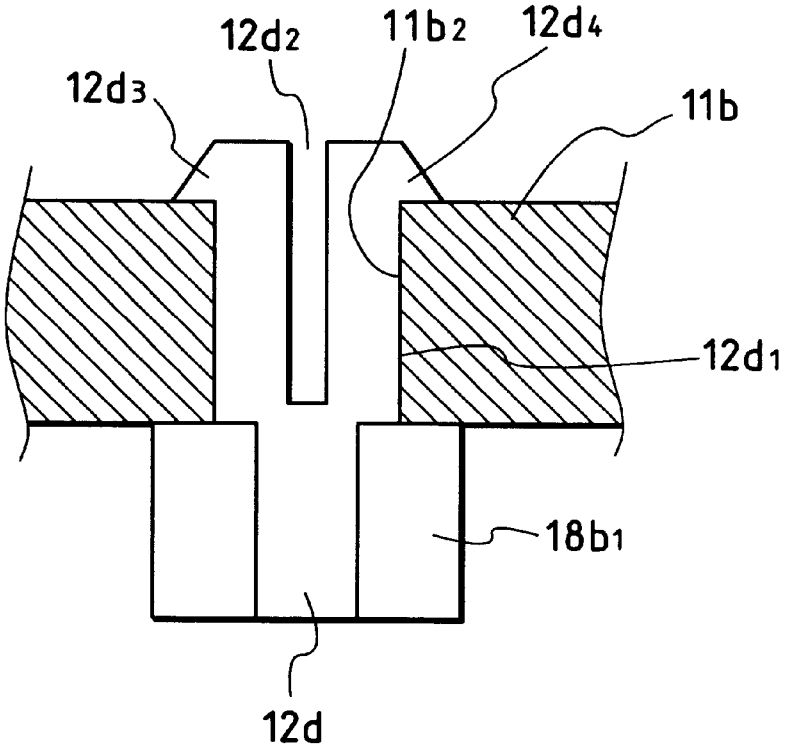
FIG. 12 is a horizonal sectional view of "a" portion of FIG. 11.

As shown in FIG. 12 which is a horizontal sectional view of a portion "a" in FIG. 11, the shaft constituting the rotary portion 12*d* is press-fitted into a root boss 18*bl* of the shutter arm 18*b*. At the rotary portion 12*d*, a cylindrical shaft portion 12*dl* is rotatably received in a hole 11*b*2 formed in the toner lower frame 11*b*. The cylindrical shaft portion 12*dl* is provided with a slit 12*d*2 passing through the center of the shaft portion and extends diametrically between opposite sides and is further provided at its the other end with an inverse pawls 12*d*3. When the shutter arm 18*b* is attached to the cartridge frame (11, 12), by inserting the rotary portion 12*d* into the hole 11*b*2 of the toner lower frame 11*b*, an inclined introduction portion 12*d*4 of the inverse pawl 12*d*3 abuts against an inlet of the hole. When the rotary portion 12*d* is further inserted, the inverse pawl 12*d*3 enters into the hole 11*b*2 while compressing the slit 12*d*2. After the rotary portion 12*d* is further advanced, when the inverse pawl 12*d*3 is passed through the hole 11*b*2, the inverse pawl is elastically restored as shown in FIG. 12, so the shutter arm 18*b* cannot be moved in the longitudinal direction.

The shutter arm 18*b* is provided with protruded portions 18*b*2, 18*b*3 positioned outwardly of and in the vicinity of the shutter rod 18*c*. The protruded portions 18*b*2, 18*b*3 have flat shapes opposed to the shutter rod 18*c* and perpendicular to the longitudinal direction and are contacted with or closely adjacent to the shutter rod 18*c*. The configurations and dimensions of the protruded portions 18*b*2, 18*b*3 are selected so that the protruded portions are always opposed to the shutter rod 18*c* during the opening and closing operations of the drum shutter 18*a*. Accordingly, at the left side of the process cartridge B, the shutter rod 18*c* is always partially covered by the shutter arm 18*b* or/and the protruded portions 18*b*2, 18*b*3 regardless of the operative condition and the inoperative condition. Incidentally, in the illustrated embodiment, the side of the shutter arm 18*b* facing to the shutter rod 18*c* is flush with the protruded portions 18*b*2, 18*b*3. If the portion of the shutter arm 18*b* facing to the shutter rod 18*c* is greatly spaced apart from the shutter rod 18*c*, the protruded portions 18*b*2, 18*b*3 are provided up to a lever portion of the shutter arm 18*b*.

However, at a position where the drum shutter 18*a* is excessively opened for the assembling and disassembling operations, it is preferable that the protruded portion 18*b*2 is not overlapped with the shutter rod 18*c*. With this arrangement, the shutter rods can be assembled and disassembled independently regardless of the assembling and disassembling of the shutter arm 18*b*. In the illustrated embodiment, while an example that the protruded portions 18*b*2, 18*b*3 are provided rearwardly of the shutter arm 18*b* in the process cartridge mounting direction was explained, the present invention is not limited such an example. That is to say, in dependence upon the configurations of the shutter arm 18*b* and the shutter rod 18*c*, positions and configurations of the protruded portions 18*b*2, 18*b*3 are varied. The tip end of the shutter arm 18*b* is rotatably attached to the longitudinal end surface of the drum shutter 18*a* via a longitudinal rotary shaft 18*b*4.

Figure 14:
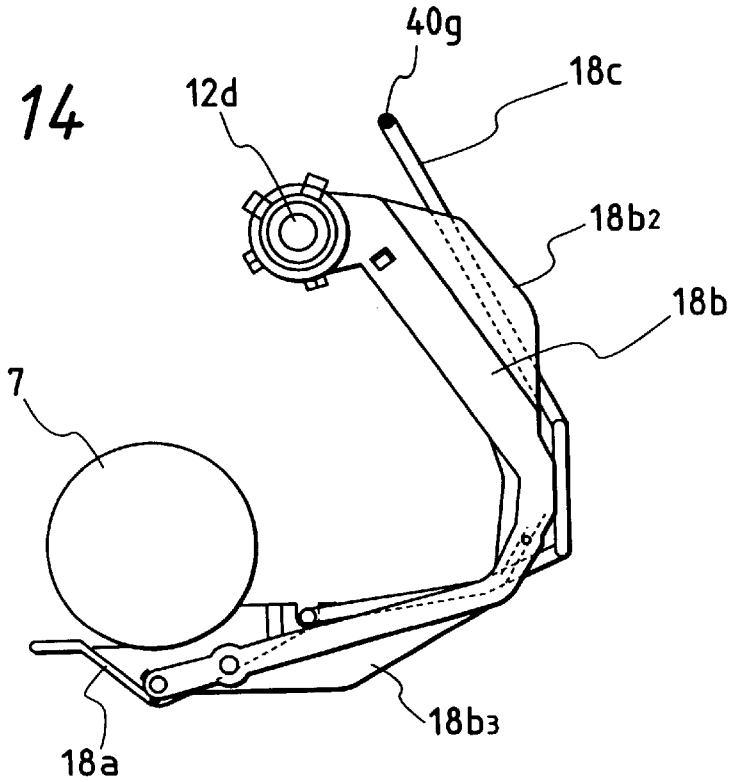
FIGS. 14 and 15 are side views showing a function of the shutter device.
Figure 15:
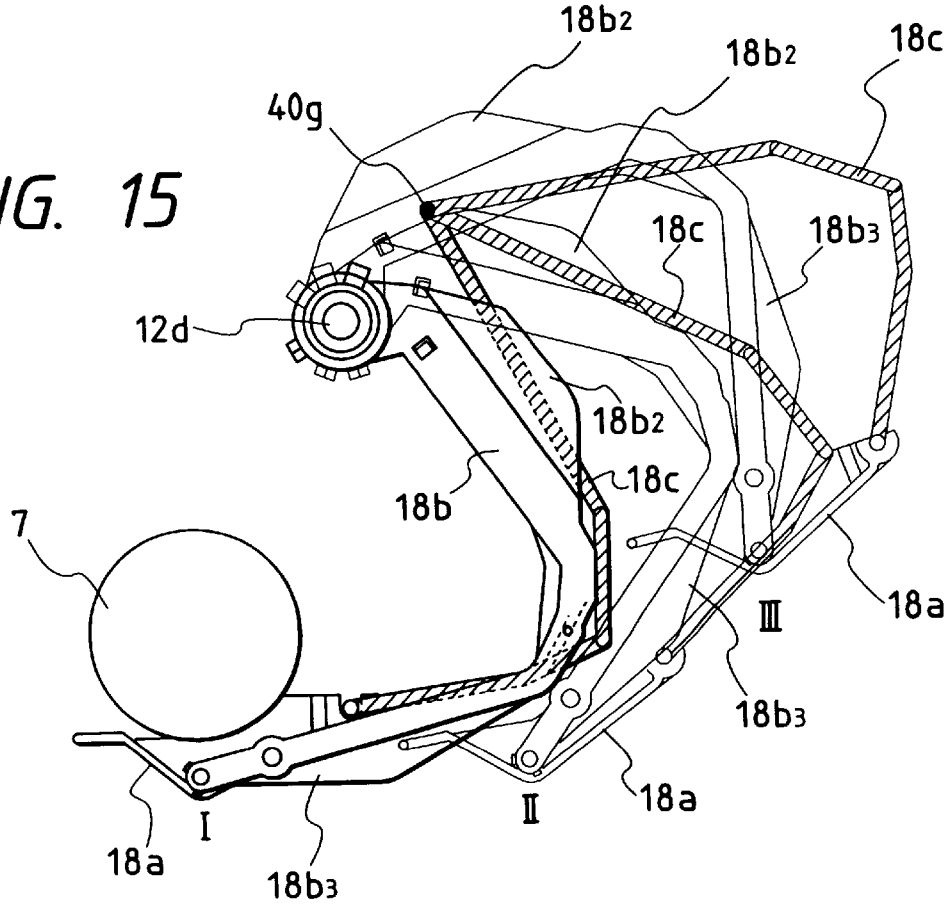

The movement of the above-mentioned shutter device is shown in FIGS. 14 and 15.

FIG. 14 shows a condition that the photosensitive drum 7 is covered by the drum shutter 18*a*, i.e., a condition that the process cartridge B is dismounted from the main body 14 of the image forming apparatus. This condition is maintained by the torsion coil spring (not shown) mounted to the rotary portion 12*d*. In this condition, the protruded portion 18*b*2 of the shutter arm 18*b* is overlapped with the shutter rod 18*c* supported by the rotary portion 40*g*, and the longitudinal movement of the shutter rod 18*c* is regulated by the protruded portion 18*b*2. "I" in FIG. 15 shows the same condition as FIG. 14.

When the operator inserts the process cartridge B into the cartridge mounting portion of the main body 14, the projections 18*cl* of the shutter rods 18*c* abut against the fixed members (not shown) of the main body 14. When the process cartridge B is further inserted into the cartridge mounting portion, only the rotary portions 12*d*, 40*g* advance leftwardly and downwardly. Accordingly, the shutter rods 18*c* are rotated around the rotary portions 40*g* in the anti-clockwise direction, thereby maintaining the drum shutter substantially in a stopped condition. The drum shutter 18*a* holds the tip end of the shutter arm 18*b* substantially in a constant or fixed position, and the shutter arm 18*b* is rotated around the rotary portion 12*d* in the anti-clockwise direction. Consequently, the process cartridge B and the photosensitive drum 7 are advanced while stopping the drum shutter 18*a*, thereby opening the transfer opening 13*n*. This condition is shown in "II" of FIG. 15. During the movement of the shutter device 18 from the condition I to the condition II, at least one of the protruded portions 18*b*2, 18*b*3 of the shutter arm 18*b* is always overlapped with the shutter rod 18*c*, thereby regulating the longitudinal movement of the shutter rod 18*c*.

From the conditions II to a condition III of FIG. 15, the photosensitive drum 7 is further advanced while keeping the drum shutter 18*a* in the constant position. In the condition III, the positioning guides 13*a*L, 13*a*R of the process cartridge B are fitted into the positioning recesses 16*b*, 16*d* of the cartridge mounting portion of the main body 14. During the movement of the shutter device 18 from the condition II to the condition III, an overlapped portion between the shutter arm 18*b* and the shutter rod 18*c* is changed from the overlapped portion between the protruded portion 18*b*2 of the shutter arm 18*b* and the lever portion of the shutter rod 18*c* to an overlapped portion between the shutter arm 18*b* itself and the lever portion of the shutter rod 18*c* including the rotary portion 40*g*. The other protruded portion 18*b*3 regulates the longitudinal movement of the shutter rod 18*c* in a front half of the movement of the shutter device 18 from the condition II to the condition III.

From the condition I to the condition III through the condition II, the shutter rod 18*c* is guided or regulated by the shutter arm 18*c* or the protruded portion 18*b*2 or 18*b*3 formed on the shutter arm 18*b*. Accordingly, during the opening and closing operations of the shutter, if any load acts in a direction perpendicular to the movement direction, the shutter rods can be prevented from disengaging from the cartridge frame (11, 12) at the rotary portions 40*g* and can be prevented from being deformed.

Also when the drum shutter 18*a* is closed, due to actions opposite to the above-mentioned ones, the shutter arm 18*b* having the protruded portions 18*b*2, 18*b*3 is overlapped with the shutter rod 18*c* at the outside thereof so that the shutter rod 18*c* is prevented from disengaging from the cartridge frame (11, 12). According to the illustrated embodiment, the shutter rod can be prevented from disengaging the cartridge frame without increasing the number of parts constituting the shutter device and without increasing any cost.

Incidentally, in the illustrated embodiment, while an example that the protruded portions are provided on the shutter arm was explained, the configuration of the shutter arm may be designed so that the shutter arm is always overlapped with the shutter rod. Alternatively, the configuration of the shutter rod may be designed so that the shutter rod is always overlapped with the shutter arm at inside thereof. Further, the configurations of the shutter arm and the shutter rod may be designed so that the shutter arm is always overlapped with the shutter rod.

(Second Embodiment)

Figure 16:
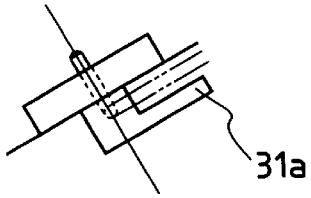
FIG. 16 is a view looked at from a direction shown by the arrow b in FIG. 17.
Figure 17:
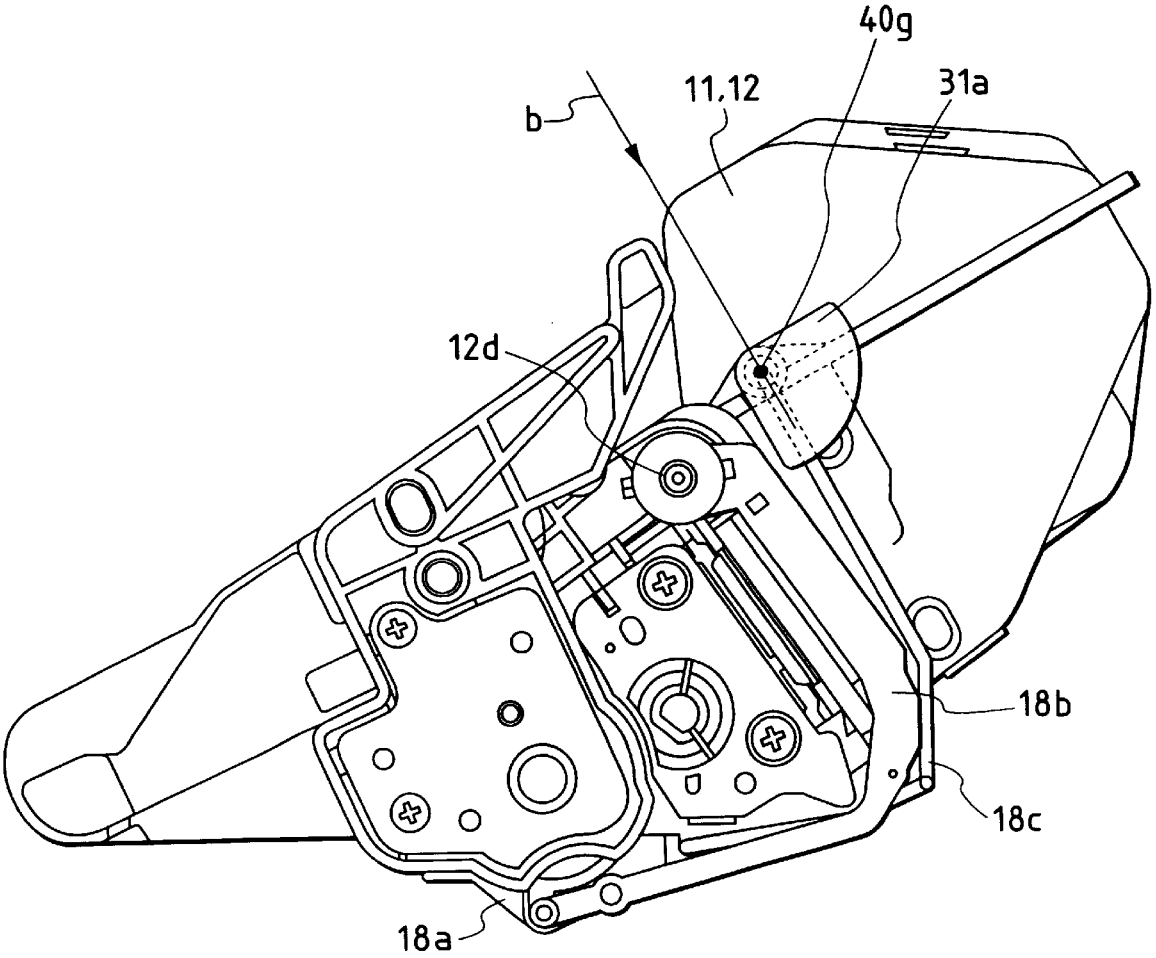
FIG. 17 is a side view of a shutter device according to a second embodiment of the present invention.

A process cartridge having a shutter device according to a second embodiment of the present invention is shown in FIGS. 16 and 17.

The shutter device 18 is constituted by shutter rods 18*c*, a shutter arm 18*b*, a drum shutter 18*a* and a cartridge frame 11, 12. The shutter rods 18*c* and the shutter arm 18*b* are rotatably supported by the cartridge frame 11, 12 for rotational movements around rotary portions 40*g*, 12*d*, respectively. Each shutter rod 18*c* is formed by bending a steel wire having a diameter of 2 mm and is rotatably attached to the cartridge frame 11, 12 via a bearing member 31.

Figure 18:
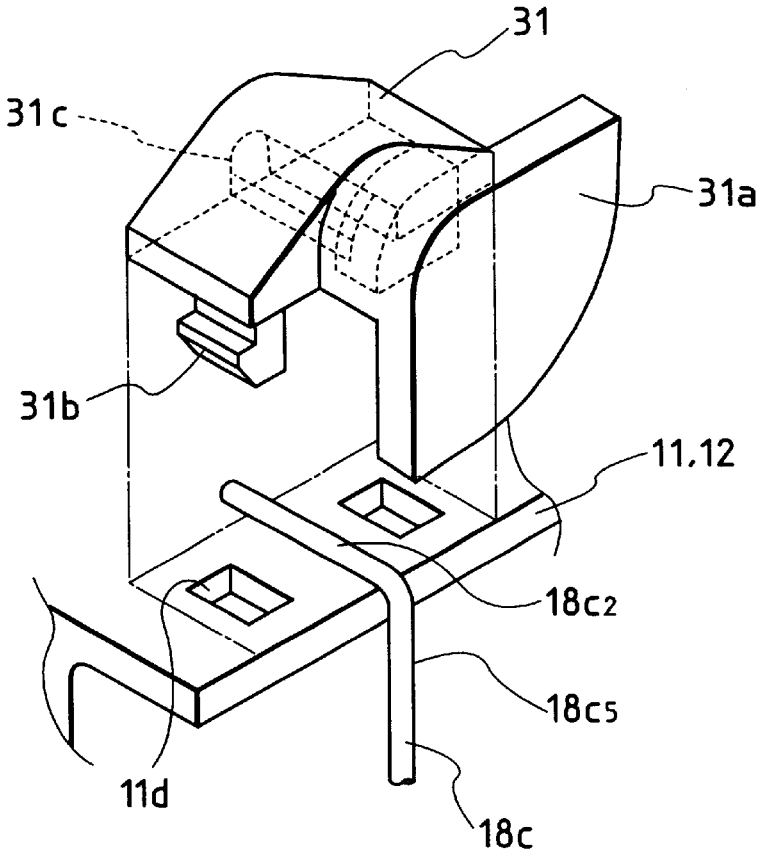
FIG. 18 is an enlarged perspective view showing a main portion of FIG. 17.
Figure 19:
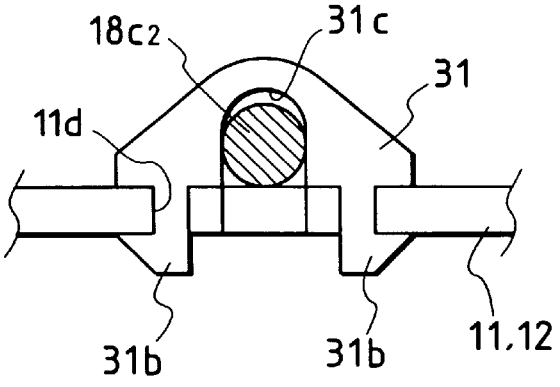
FIG. 19 is a sectional view of a portion of FIG. 18.

The shutter rod 18*c* is shown in FIGS. 18 and 19.

The bearing member 31 is secured to the cartridge frame 11, 12 by inserting elastic securing pawls 31*b* each having an outwardly directing inverse pawl portion into a hole lid of the cartridge frame 11, 12 while pinching a rotary shaft 18*c*2 of the shutter rod 18*c* between the cartridge frame 11, 12 and the bearing member 31. In the assembled condition, the rotary shaft 18*c*2 of the end of the shutter rod 18*c* is rotatably held in a recess 31*c* of the bearing member 31, and a lever portion 18*c*5 of the shutter rod 18*c* is pinched between a flat-plate shaped flange 31*a* perpendicular to the longitudinal direction of the bearing member 31 and the cartridge frame 11, 12 with great gaps.

Figure 20:
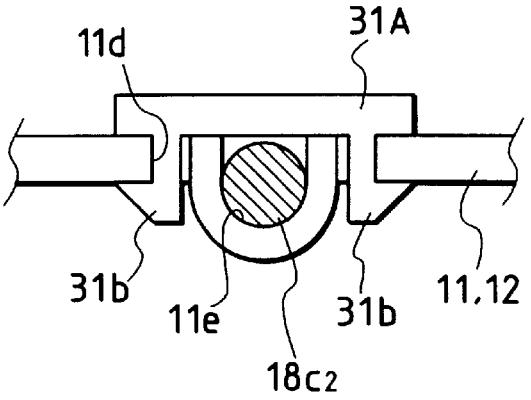
FIG. 20 is a sectional view showing an alteration of FIG. 19.

Thus, if any load acts in a direction perpendicular to a movement plane during the opening and closing operations of the shutter, the shutter rod 18*c* can be prevented from disengaging from the cartridge frame 11, 12 at the rotary portion 40*g* (18*c*2, 31*c*) and can be prevented form being deformed. Incidentally, in the illustrated embodiment, as shown in FIG. 19, while an example that the rotary shaft 18*c*2 of the shutter rod 18*c* is held in the recess 31*c* of the bearing member 31 was explained, an arrangement as shown in FIG. 20 may be adopted. In FIG. 20, a recessed portion 11*e* is provided on the cartridge frame 11, 12 and the rotary shaft 18*c*2 of the shutter rod 18*c* is fitted into the recessed portion 11*e*. Then, a shaft hold-down member 31A having the bearing member 31 having no recess 31*c* is attached to the cartridge frame 11, 12 to prevent the rotary shaft 18*c*2 from disengaging from the recessed portion 11*e*. In this way, the shutter rod 18*c* is supported.

(Third Embodiment)

Figure 21:
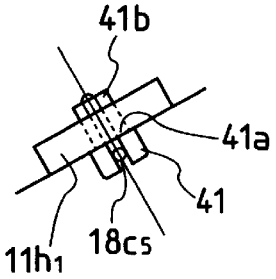
FIG. 21 is a view looked at from a direction shown by the arrow c in FIG. 22.
Figure 22:
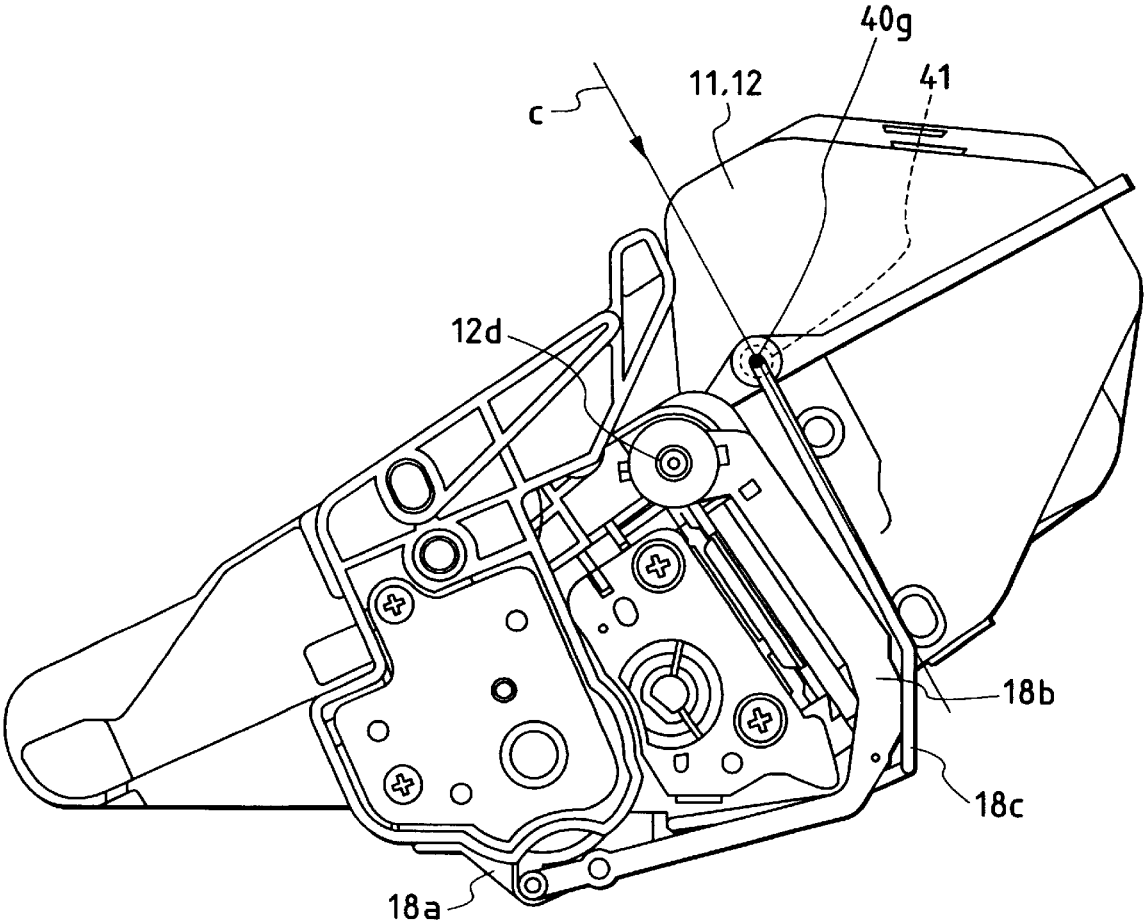
FIG. 22 is a side view of a shutter device according to a third embodiment of the present invention.

A process cartridge having a shutter device according to a third embodiment of the present invention is shown in FIGS. 21 and 22.

The shutter device 18 is constituted by shutter rods 18*c*, a shutter arm 18*b*, a drum shutter 18*a* and a cartridge frame 11, 12. The shutter rods 18*c* and the shutter arm 18*b* are rotatably supported by the cartridge frame 11, 12 for rotational movements around rotary portions 40*g*, 12*d*, respectively. Each shutter rod 18*c* is formed by bending a steel wire having a diameter of 2 mm and is rotatably attached to the cartridge frame 11, 12 via a shaft member 41.

The rotary portion 40*g* is shown in FIG. 23. As shown, a rotary shaft 18*c*2 of a tip end of the L-shaped shutter rod 18*c* is passed through a hole 41*f* formed in a central portion of the cylindrical shaft member 41 made of resin, and a lever portion 18*c*5 (of the shutter rod) bent from the tip end by a right angle is fitted into a recess 41*d* of the shaft member 41. In a condition that the shutter rod 18*c* and the shaft member 41 are assembled, the assembly is axially inserted into a cylindrical through hole 11*f* formed in the boss 11*hl* of the toner lower frame 11*b*. The shaft member 41 has a plurality of projections 41*b* protruded radially, and the projections 41*b* situated on a tapered envelope cylinder. A diameter defined by front ends (in the inserting direction) of the projections is greater than a diameter of the cylindrical hole 11*f* and a diameter defined by rear ends (in the inserting direction) of the projections is smaller than the diameter of the cylindrical hole 11*f*. Each projection 41*b* is surrounded by a U-shaped hole 41*bl* passing through the shaft member 41 diametrically at three sides thereof. When the shaft member 41 is inserted into the cylindrical hole 11*f*, the projections 41*b* are compressed by the inner wall of the cylindrical hole to be elastically deformed so that the maximum diameter defined by the projections becomes the same as the diameter of the cylindrical hole 11*f*.

FIG. 24 is a sectional view showing the assembled rotary portion 40*g*. In the assembled condition, the rear ends of the projections 41*b* of the shaft member 41 have been passed through the cylindrical hole 11*f* to restore the projections to their original shapes. In this condition, the boss 11*hl* of the cartridge frame 11, 12 is pinched between the projections 41 and a stepped shoulder 41*a* of the shaft member 41, the axial movement of the shaft member 41 is regulated.

FIG. 25 shows the configuration of the recess 41*d* of the shaft member 41. A diameter d is selected to be substantially the same as the outer diameter of the rotary shaft 18*c*2 of the shutter rod 18*c*, and a width t of an insertion inlet is smaller than the diameter d by 0.3 to 0.7 mm. As a result, when the rotary shaft 18*c*2 of the shutter rod 18*c* is assembled within the shaft member 41 and the lever portion 18*c*5 of the shutter rod 18*c* is fitted into a bottom 41*e* of the recess, the shutter rod 18*c* cannot be disengaged from the shaft member 41 in the axial direction.

Thus, since the rotary portion 40*g* provides a rotary portion regulating the axial movement, if any load acts in a direction perpendicular to a movement plane during the opening and closing operations of the shutter, the shutter rod 18*c* can be prevented from disengaging from the cartridge frame 11, 12 at the rotary portion 40*g* and can be prevented from being deformed.

As mentioned above, according to the embodiments of the present invention, the connection member for connecting the shutter member to the cartridge frame can easily be attached to the cartridge frame.

Further, according to the embodiment of the present invention, the second connection member regulates the movement of the first connection member in the direction that the first connection member is disengaged from the cartridge frame. Accordingly, the end of the first connection member can be prevented from disengaging from the cartridge frame.

According to the embodiment of the present invention, the movement regulating member provided on the cartridge frame regulates the outward movement of the connection member in the longitudinal direction of the shutter member. Accordingly, the end of the connection member can be prevented from disengaging from the cartridge frame.

What is claimed is:

1. A process cartridge detachably mountable to a main body of an electrophotographic image forming apparatus, said process cartridge comprising:

(a) a cartridge frame;

(b) an electrophotographic photosensitive member supported by said cartridge frame;

(c) process means supported by said cartridge frame to act on said electrophotographic photosensitive member;

(d) a shutter member for protecting a portion of said electrophotographic photosensitive member exposed from said cartridge frame;

(e) a first connection member to connect said cartridge frame and said shutter member and rotatable with respect to said cartridge frame and detachably attached to said cartridge frame, said first connection member being contacted with an engagement portion of said main body when the process cartridge is mounted to said main body, to receive a force for opening said shutter member from a protection position where said exposed portion of said electrophotographic photosensitive member is protected to a retract position; and (f) a second connection member to connect said cartridge frame and said shutter member and rotatable with respect to said cartridge frame and attached to said cartridge frame while regulating an axial movement of said second connection member during rotation of said second connection member, said second connection member regulating a movement of said first connection member in a direction that said first connection member is disengaged from said cartridge frame, in order to prevent an end of said first connection member from disengaging from said cartridge frame.

2. A process cartridge according to claim 1, wherein the direction that said first connection member is disengaged from said cartridge frame is an outward direction in a longitudinal direction of said shutter member.

3. A process cartridge according to claim 2, wherein said second connection member has a portion overlapped with said first connection member ahead of said first connection member looked at from the outside of the longitudinal direction of said shutter member when said shutter member is opened from said protection position to said retract position, whereby the outward movement of said first connection member in the longitudinal direction of said shutter member is regulated.

4. A process cartridge according to claim 3, wherein said second connection member has a first regulating portion for regulating the outward movement of said first connection member in the longitudinal direction of said shutter member, and wherein said first regulating portion is protruded from said second connection member toward an upstream side in a mounting direction along which the process cartridge is mounted to said main body.

5. A process cartridge according to claim 4, wherein said second connection member has a second regulating portion for regulating the outward movement of said first connection member in the longitudinal direction of said shutter member, and wherein said second regulating portion is protruded from said second connection member toward a direction that said second regulating portion faces downwardly when the process cartridge is mounted to said main body.

6. A process cartridge according to claim 5, wherein a surface of said first regulating portion opposed to said first connection member is in flush with a surface of said second regulating portion opposed to said first connection member.

7. A process cartridge according to claim 1 or 6, wherein said first and second connection members are connected to one end of said cartridge frame in the longitudinal direction thereof, further comprising a third connection member for connecting said cartridge frame and said shutter member, and wherein said third connection member is connected to the other end of said cartridge frame opposite to said one end in the longitudinal direction, and said third connection member is rotatable with respect to said cartridge frame and is attached to said other end in such a manner that said third connection member cannot be detached from said other end within an operation area for opening said shutter member from said protection position to said retract position.

8. A process cartridge according to claim 7, wherein said third connection member is attached to said other end in such a manner that said third connection member can be detached from said other end when said shutter member is further opened beyond said retract position.

9. A process cartridge according to claim 8, further comprising a connecting member disposed along the longitudinal direction of said shutter member, and wherein said first and third connection members are integrally connected to each other via said connecting member.

10. A process cartridge according to claim 9, wherein said shutter member is supported by said first, second and third connection members in such a manner that said shutter member can be rotated with respect to said first, second and third connection members when said shutter member is opened from said protection position to said retract position.

11. A process cartridge detachably mountable to a main body of an electrophotographic image forming apparatus, said process cartridge comprising:

(a) a cartridge frame;

(b) an electrophotographic photosensitive drum supported by said cartridge frame;

(c) process means supported by said cartridge frame to act on said electrophotographic photosensitive drum;

(d) a shutter member for protecting a portion of said electrophotographic photosensitive drum exposed from said cartridge frame;

(e) a first connection member for connecting one end of said cartridge frame in a longitudinal direction thereof and said shutter member, an end of said first connection member connected to said one end of said cartridge frame being rotatable with respect to said cartridge frame to be detachably attached to said one end of said cartridge frame, and said first connection member being contacted with an engagement portion of said main body when the process cartridge is mounted to said main body, to receive a force for opening said shutter member from a protection position where said exposed portion of said electrophotographic photosensitive drum is protected to a retract position;

(f) a second connection member for connecting said one end of said cartridge frame and said shutter member, an end of said second connection member connected to said one end of said cartridge frame being rotatable with respect to said cartridge frame to be attached to said one end of said cartridge frame while regulating an axial movement of said second connection member in the longitudinal direction of said shutter member, and said second connection member having a portion overlapped with said first connection member ahead of said first connection member looked at from the outside of the longitudinal direction of said shutter member when said shutter member is opened from said protection position to said retract position, whereby said second connection member regulates the outward movement of said first connection member in the longitudinal direction of said shutter member, in order to prevent said end of said first connection member from said one end of said cartridge frame;

(g) a third connection member for connecting the other end of said cartridge frame opposite to said one end in the longitudinal direction and said shutter member, an end of said third connection member connected to said other end of said cartridge frame being rotatable with respect to said cartridge frame to be attached to said other end in such a manner that said third connection member cannot be detached from said other end within an operation area for opening said shutter member from said protection position to said retract position, and said third member being contacted with an engagement portion of said main body when the process cartridge is mounted to said main body, to receive a force for opening said shutter member from said protection position where said exposed portion of said electrophotographic photosensitive drum is protected to said retract position; and (h) a grip portion to be gripped when the process cartridge is mounted to said main body, in which, when the process cartridge is mounted to said main body by gripping said grip portion, said shutter member is rotated toward a direction where said grip portion is positioned.

12. A process cartridge according to claim 11, wherein said second connection member has a first regulating portion for regulating the outward movement of said first connection member in the longitudinal direction of said shutter member, and wherein said first regulating portion is protruded from said second connection member toward an upstream side in a mounting direction along which the process cartridge is mounted to said main body.

13. A process cartridge according to claim 12, wherein said second connection member has a second regulating portion for regulating the outward movement of said first connection member in the longitudinal direction of said shutter member, and wherein said second regulating portion is protruded from said second connection member toward a direction that said second regulating portion faces downwardly when the process cartridge is mounted to said main body.

14. A process cartridge according to claim 13, wherein a surface of said first regulating portion opposed to said first connection member is in flush with a surface of said second regulating portion opposed to said first connection member.

15. A process cartridge according to claim 11 or 14, wherein said end of said third connection member connected to said other end of said cartridge frame is attached to said other end in such a manner that said third connection member can be detached from said other end of said cartridge frame when said shutter member is further opened beyond said retract position.

16. A process cartridge according to claim 15, further comprising a connecting member disposed along the longitudinal direction of said shutter member, and wherein said first and third connection members are integrally connected to each other via said connecting member.

17. A process cartridge according to claim 16, wherein said shutter member is supported by said first, second and third connection members in such a manner that said shutter member can be rotated with respect to said first, second and third connection members when said shutter member is opened from said protection position to said retract position.

18. A process cartridge according to claim 17, wherein said cartridge frame has a first frame including said electrophotographic photosensitive drum, a charge member for charging said electrophotographic photosensitive drum and a cleaning member for removing residual toner remaining on said electrophotographic photosensitive drum; and a second frame including a developing member for developing a latent image formed on said electrophotographic photosensitive drum; and said first, second and third connection members are provided on said second frame.

19. A process cartridge detachably mountable to a main body of an electrophotographic image forming apparatus, said process cartridge comprising:

(a) a cartridge frame;

(b) an electrophotographic photosensitive drum supported by said cartridge frame;

(c) process means supported by said cartridge frame to act on said electrophotographic photosensitive drum;

(d) a shutter member for protecting a portion of said electrophotographic photosensitive drum exposed from said cartridge frame;

(e) a connection member for connecting one end of said cartridge frame in a longitudinal direction thereof and said shutter member, an end of said connection member connected to said one end of said cartridge frame being rotatable with respect to said cartridge frame to be attached to said one end of said cartridge frame, and said connection member being contacted with an engagement portion of said main body when the process cartridge is mounted to said main body, to receive a force for opening said shutter member from a protection position where said exposed portion of said electrophotographic photosensitive drum is protected to a retract position; and (f) a movement regulating member provided on said cartridge frame to regulate an outward movement of said connection member in the longitudinal direction of said shutter member to prevent said connection member from disengaging from said cartridge frame.

20. A process cartridge according to claim 19, wherein said movement regulating member has a portion overlapped with said connection member ahead of said connection member looked at from the outside of the longitudinal direction of said shutter member when said shutter member is opened from said protection position to said retract position, whereby the outward movement of said connection member in the longitudinal direction of said shutter member is regulated.

21. A process cartridge according to claim 19, wherein said cartridge frame has a protruded portion having a hole, and said movement regulating member has a recess into which one end of said connection member is press-fitted, a shaft portion fitting into said hole, a shoulder provided on said protruded portion in an opposed relation to one end surface of said hole in an axial direction, and a projection provided on said protruded portion in an opposed relation to the other end surface of said hole opposite to said one end surface in the axial direction, whereby the outward movement of said connection member in the longitudinal direction of said shutter member is regulated.

22. A process cartridge according to claim 1, 11 or 19, wherein the process cartridge incorporates therein said electrophotographic photosensitive drum, and at least one of a charge member for charging said electrophotographic photosensitive drum, a developing member for developing a latent image formed on said electrophotographic photosensitive drum and a cleaning member for removing residual toner remaining on said electrophotographic photosensitive drum which act as said process means, as a cartridge unit which can detachably be mounted to said main body.

23. An electrophotographic image forming apparatus for forming an image on a recording medium, said electrophotographic image forming apparatus comprising:

(a) a mounting means for detachably mounting to, a main body of the image forming apparatus, a process cartridge including a cartridge frame, an electrophotographic photosensitive member supported by said cartridge frame, process means supported by said cartridge frame and act on said electrophotographic photosensitive member, a shutter member for protecting a portion of said electrophotographic photosensitive member exposed from said cartridge frame, a first connection member adapted to connect said cartridge frame and said shutter member and rotatable with respect to said cartridge frame and detachably attached to said cartridge frame, said first connection member being contacted with an engagement portion of said main body when the process cartridge is mounted to said main body, to receive a force for opening said shutter member from a protection position where said exposed portion of said electrophotographic photosensitive member is protected to a retract position, and a second connection member to connect said cartridge frame and said shutter member and rotatable with respect to said cartridge frame and attached to said cartridge frame while regulating an axial movement of said second connection member during rotation of said second connection member, said second connection member regulating a movement of said first connection member in a direction that said first connection member is disengaged from said cartridge frame, in order to prevent an end of said first connection member from disengaging from said cartridge frame; and (b) an engagement member contacted with said first connection member when said process cartridge is mounted to said main body to apply to said first connection member the force for opening said shutter member from said protection position where said exposed portion of said electrophotographic photosensitive member is protected to said retract position.

24. An electrophotographic image forming apparatus for forming an image on a recording medium, said electrophotogrpahic image forming apparatus comprising:

(a) a mounting means for detachably mounting to, a main body of the image forming apparatus, a process cartridge including a cartridge frame, an electrophotographic photosensitive drum supported by said cartridge frame, process means supported by said cartridge frame to act on said electrophotographic photosensitive drum, a shutter member for protecting a portion of said electrophotographic photosensitive drum exposed from said cartridge frame, a first connection member for connecting one end of said cartridge frame in a longitudinal direction thereof and said shutter member, an end of said first connection member connected to said one end of said cartridge frame being rotatable with respect to said cartridge frame to be detachably attached to said one end of said cartridge frame, and said first connection member being contacted with an engagement portion of said main body when the process cartridge is mounted to said main body, to receive a force for opening said shutter member from a protection position where said exposed portion of said electrophotographic photosensitive drum is protected to a retract position, a second connection member for connecting said one end of said cartridge frame and said shutter member, an end of said second connection member connected to said one end of said cartridge frame being rotatable with respect to said cartridge frame to be attached to said one end of said cartridge frame while regulating an axial movement of said second connection member in the longitudinal direction of said shutter member, and said second connection member having a portion overlapped with said first connection member ahead of said first connection member looked at from the outside of the longitudinal direction of said shutter member when said shutter member is opened from said protection position to said retract position, whereby said second connection member regulates the outward movement of said first connection member in the longitudinal direction of said shutter member, in order to prevent said end of said first connection member from said one end of said cartridge frame, a third connection member for connecting the other end of said cartridge frame opposite to said one end in the longitudinal direction and said shutter member, an end of said third connection member connected to said other end of said cartridge frame being rotatable with respect to said cartridge frame and being attached to said other end in such a manner that said third connection member cannot be detached from said other end within an operation area for opening said shutter member from said protection position to said retract position, and said third member being contacted with an engagement portion of said main body when the process cartridge is mounted to said main body, to receive a force for opening said shutter member from said protection position where said exposed portion of said electrophotographic photosensitive drum is protected to said retract position, and a grip portion to be gripped when the process cartridge is mounted to said main body, in which, when the process cartridge is mounted to said main body by gripping said grip portion, said shutter member is rotated toward a direction where said grip portion is positioned; and (b) an engagement member contacted with said first and third connection members when said process cartridge is mounted to said main body to apply to said first and third connection members the force for opening said shutter member from said protection position where said exposed portion of said electrophotographic photosensitive drum is protected to said retract position.

25. An electrophotographic image forming apparatus for forming an image on a recording medium, said electrophotographic image forming apparatus comprising:

(a) a mounting means for detachably mounting to, a main body of the image forming apparatus, a process cartridge including a cartridge frame, an electrophotographic photosensitive drum supported by said cartridge frame, process means supported by said cartridge frame to act on said electrophotographic photosensitive drum, a shutter member for protecting a portion of said electrophotographic photosensitive drum exposed from said cartridge frame, a connection member for connecting one end of said cartridge frame in a longitudinal direction thereof and said shutter member, an end of said connection member connected to said one end of said cartridge frame being rotatable with respect to said cartridge frame to be attached to said one end of said cartridge frame, and said connection member being contacted with an engagement portion of said main body when the process cartridge is mounted to said main body, to receive a force for opening said shutter member from a protection position where said exposed portion of said electrophotographic photosensitive drum is protected to a retract position, and a movement regulating member provided on said cartridge frame to regulate an outward movement of said connection member in the longitudinal direction of said shutter member to prevent said connection member from disengaging from said cartridge frame; and (b) an engagement member contacted with said connection member when said process cartridge is mounted to said main body to apply to said connection member the force for opening said shutter member from said protection position where said exposed portion of said electrophotographic photosensitive drum is protected to said retract position.

* * * * *

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 1:

Line 8, "the" should read --the term--.
Line 9, "is" should read --refers to--.
Line 16, "The" should read --The term--.
Line 20, "mounted" should read --be mounted--.
Line 25, "ratus" should read --ratus,--.
Line 26, "like" should read --like,--.
Line 28, "is" should read --are--.
Line 35, "is" should read --has been--.
Line 36, "the" (first occurrence) should read --its--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 1

Line 41, "ably" should read --ably be--.
Line 46, "In a condition that" should read --When--.
Line 48, "by" should read --with--.
Line 59, "detachably" should read --detachably be--.
Line 65, "detachably" should read --detachably be--.

COLUMN 2:

Line 4, "detachably" should read --detachably be--.
Line 10, "detachably" should read --detachably be--.
Line 12, "is contacted with" should read --contacts--.
Line 15, "position" should read --position,--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 2

Line 17, "protected" should read --protected,--.
Line 25, "detachably" should read --detachably be--.
Line 42, "position" should read --position,--.
Line 43, "protected"should read --protected,--.

COLUMN 3:

Line 2, "looked at" should read --when viewed--.
Line 8, "looked at" should read --when viewed--.
Line 27, "view" should read --view of the present invention when it is--.
Line 7 , "view" should read --view of the present invention when it is--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 4

Line 10, "positioned upside" should read --positioned on the upside of the cartridge--.
Line 12, "positioned downside" should read --positioned on the downside of the cartridge--.
Line 24, "as" should read --as a--.
Line 28, "illuminating" should read --illuminating the photosensitive drum with--.
Line 30, "onto the photosensitive drum" should be deleted.
Line 32, "synchronous" should read --synchronism--.
Line 34, "pairs" should read --a pair--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 4

Line 51, "without" should be deleted.
Line 53, "pairs" should read --the pairs--, and "pair" should read --the pair--.
Line 54, "convey" should read --the convey--, and "pairs" should read --the pairs--.
Line 55, "pair" should read --the pair--.
Line 61, "illuminating" should read --illuminating the photosensitive drum with--.
Line 62, "onto the" should be deleted.
Line 63, "photosensitive drum 7" should be deleted.

COLUMN 5:

Line 19, "apply the" should read --applying a--.
Line 18, "a thickness" should read --the thickness--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 5

Line 25, "having" should read --having a--.
Line 30, "contacted with" should read --contacting--.
Line 36, "cleaning" should read --the cleaning--.
Line 37, "joined." should read --joined thereto.--.
Line 56, "charge" should read --the charge--, and "developing" should read --the developing--.
Line 58, "detachably" should read --detachably be--.

COLUMN 6:

Line 3, "extending" should read --extending in--.
Line 12, "matters" should read --matter--.
Line 41, "different" should read --different from--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 6

Line 60, "In the condition that" should read --When--.
Line 66, "charge" should read --the charge--; and "cleaning" should read --the cleaning--.

COLUMN 7:

Line 48, "is" should read --are--.
Line 60, "13aL" should read --13aL,--; and "is" should be deleted.
Line 61, "protruded" should read --protrudes--.

COLUMN 8:

Line 13, "positioned" should read --positioned on the--.
Line 28, "regulation" should read --regulating--.
Line 32, "anti-clockwise" should read --counter-clockwise--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 8

Line 49, "Widths" should read --The widths--.
Line 53, "13aL" should read --13aL, which--.
Line 57, "with" should read --while--.
Line 58, "In the condition" should read --When--.
Line 59, "that" should be deleted.
Line 66, "a" should read --the--.

COLUMN 9:

Line 1, "between" should be deleted.
Line 2, "a" should read --the--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 9

Line 4, "primary" should read --the primary--.
Line 5, "primary" should read --the primary--.
Line 22, "recessed" should read --recesses--.
Line 24, "recessed" should read --recesses--.
Line 29, "between" should be deleted.
Line 51, "reversely" should read --in reverse--.

COLUMN 10:

Line 10, "robs" should read --rods--.
Line 13, "robs" should read --rods--.
Line 14, "an anti-clockwise" should read --a counter-clockwise--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 10

Line 39, "is contacted" should read --contacts--.
Line 40, "with" should be deleted.
Line 44, "the" should be deleted.
Line 49, "in" should be deleted.
Line 57, "to" should read --thereinto--.
Line 60, "adhe-" should read --an adhe--.
Line 66, "to" should read --in--.
Line 67, "similar" should read --in a similar manner--.

COLUMN 11:

Line 9, "(left" should read --(the left--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 11

Line 10, "right" should read --the right--.
Line 13, "left" should read --the left--.
Line 34, "the" (2nd occurrence) should be deleted.
Line 42, "the" (1st occurrence) should read --a--.
Line 45, "moved" should read --moved in the--.
Line 48, "FIG. 12" should read --FIG. 12,--.
Line 56, "its" should be deleted.
Line 57, "pawls" should read --pawl--.
Line 65, "is" (1st occurrence) should read --has--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 12:

Line 5, "are contacted with or" should read --contact or are--.
Line 15, "to" should be deleted.
Line 17, "to" should be deleted.
Line 23, "is" should read --does--.
Line 24, "overlapped with" should read --overlap--.
Line 26, "independently" should read --independently,--.
Line 33, "positions" should read --the positions--.
Line 34, "are" should read --can be--.
Line 40, "that" should read --in which--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 12

Line 41, "a" should read --the--; and "that" should read --in which--.
Line 46, "is overlapped with" should read --overlaps--.
Line 58, "anti-" should read --counter--.
Line 63, "anti-" should read --counter--.

COLUMN 13:

Line 3, "is always overlapped with" should read --always overlaps--.
Line 25, "18c" should read --18b--.
Line 34, "is overlapped with" should read --overlaps--.
LINE 40, "any cost." should read --the cost of the cartridge--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 13

Line 44, "is" should be deleted.
Line 45, "overlapped with" should read --overlaps--.
Line 47, "is always overlapped with" should read --overlaps--, and "inside" should read --the inside--.
Line 49, "is" should be deleted.
Line 50, "overlapped with" should read --overlaps--.
Line 65, "31b" should read --31b,--.
Line 66, "portion" should read --portion,--; and "lid" should read --11d--.

COLUMN 14:

Line 6, "31a" should read --31a,--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 14

Line 7, "31" should read --31,--.
Line 13, "form" should read --from--.
Line 40, "is passed" should read --passes--.
Line 44, "a" should read --the--.
Line 48, "protruded" should read --protruding--.
Line 49, "situated" should read --are situated--.

COLUMN 15:

Line 1, "41," should read --41, and--.
Line 14, "the" should be deleted.
Line 53, "being contacted with" should read --contacting--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 15

Line 56, "position" should read --position,--.
Line 58, "protected" should read --protected,--.
Line 67, "that" should read --in which--.

COLUMN 16:

Line 5, "that" should read --in which--.
Line 9, "overlapped with" should read --overlapping--.
Line 11, "looked at" should read --when viewed--; and "of" should read --in--.
Line 21, "is protruded" should read --protrudes--.
Line 22, "side" should read --side of said cartridge--.
Line 29, "is protruded" should read --protrudes--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 16

Line 30, "toward" should read --in--; and "that" should read --in which--.
Line 35, "in" should be deleted.
Line 40, "thereof," should read --thereof, said process cartridge--.
Line 42, "is connected to" should read --contacts--.
Line 44, "and" should read --and wherein--.

COLUMN 17:

Line 6, "a" should read --an exposed--.
Line 15, "and" should read --and wherein--.
Line 16, "being contacted with" should read --contacts--.
Line 19, "position" should read --position,--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 17

Line 21, "protected" should read --protected,--.
Line 27, "an" should be deleted.
Line 29, "and" should read --and wherein--.
Line 30, "having" should read --has--.
Line 31, "lapped with" should read --lapping--.
Line 39, "from" should read --from disengaging--.
Line 42, "frame" should read --frame,--.
Line 43, "direction" should read --direction,--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 17

Line 50, "and" should read --and wherein--.
Line 51, "being contacted with" should read --contacts--.
Line 55, "position" should read --position,--.
Line 56, "protected" should read --protected,--.
Line 59, "in which" should read --wherein--.

COLUMN 18:

Line 2, "is protruded" should read --protrudes--.
Line 3, "side" should read --side of said cartridge--.
Line 11, "is protruded" should read --protrudes--; and "toward" should read --in --.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 18

Line 12, "that" should read --in which--.
Line 17, "in" should be deleted.
Line 55, "a" should read --an exposed--. (second occurrence)
Line 63, "and" should read --and wherein--.
Line 64, "being contacted with" should read --contacts--.

COLUMN 19:

Line 2, "position" should read --position,--.
Line 3, "protected" should read --protected,--.
Line 6, "an" should be deleted.
Line 11, "overlapped" should read --overlapping--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 19

Line 12, "with" should be deleted.
Line 13, "looked at" should read --when viewed--; and "of" should read --in--.
Line 23, "hole," should read --hole, and wherein said cartridge further comprises--.
Line 44, "to," should read --to--.
Line 49, "act" should read --acting--.
Line 50, "a portion" should read --an exposed portion--.
Line 56, "being con-" should read --contacting--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 19

Line 57, "tacted with" should be deleted.
Line 60, "position" should read --position,--.
Line 62, "protected" should read --protected,--.
Line 64, "rotatable" should read --being rotatable--.

COLUMN 20:

Line 3, "that" should read --in which--.
Line 7, "contacted with" should read --contacting--.
Line 11, "position" should read --position,--.
Line 13, "protected" should read --protected,--.
Line 16, "togrpahic" should read--tographic--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 20

Line 17, "a" (1st occurrence) should be deleted, and "to," should read --to--.
Line 31, "and" should read --and wherein--.
Line 32, "being contacted with" should read --contacts--.
Line 36, "position" should read --position,--.
Line 37, "protected" should read --protected,--.
Line 46, "and" should read --and wherein--.
Line 47, "overlapped with" should read --overlapping--.
Line 56, "from" should read --from disengaging from--.
Line 67, "and" should read --and wherein--; and "being contacted" should read --contacts--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 21:

Line 1, "with" should be deleted.
Line 4, "position" should read --position,--.
Line 6, "tected" should read --tected,--.
Line 8, "in which," should read--wherein--.
Line 12, "contacted with" should read --contacting--.
Line 16, "position" should read --position,--.
Line 18, "protected" should read --protected,--.
Line 22, "to," should read --to--.
Line 28, "a portion" should read --an exposed portion--.

UNITED STATES PATENT AND TRADEMARK OFFICE

CERTIFICATE OF CORRECTION

PATENT NO. : 5,937,242

DATED : August 10, 1999

INVENTOR(S): KATSUNORI YOKOYAMA, ET AL.

It is certified that error appears in the above-identified patent and that said Letters Patent is hereby corrected as shown below:

COLUMN 22:

Line 8, "and" should read --and wherein--; and "being" should be deleted.
Line 9, "contacted with" should read --contacts--.
Line 12, "position" should read --position,--.
Line 14, "protected" should read --protected,--.
Line 20, "contacted with" should read --contacting--.
Line 24, "position" should read --position,--.
Line 25, "protected" should read --protected,--.

Signed and Sealed this

Nineteenth Day of December, 2000

*Attest:*

*Attesting Officer*

Q. TODD DICKINSON

*Commissioner of Patents and Trademarks*